US010770008B2

(12) United States Patent
Sako et al.

(10) Patent No.: US 10,770,008 B2
(45) Date of Patent: Sep. 8, 2020

(54) DISPLAY DEVICE WITH DIMMING PANEL

(71) Applicant: Japan Display Inc., Tokyo (JP)

(72) Inventors: Kazuhiko Sako, Tokyo (JP); Daichi Suzuki, Tokyo (JP); Naoyuki Takasaki, Tokyo (JP); Tsutomu Harada, Tokyo (JP); Kojiro Ikeda, Tokyo (JP)

(73) Assignee: Japan Display Inc., Tokyo (JP)

( * ) Notice: Subject to any disclaimer, the term of this patent is extended or adjusted under 35 U.S.C. 154(b) by 85 days.

(21) Appl. No.: 16/039,440

(22) Filed: Jul. 19, 2018

(65) Prior Publication Data

US 2019/0035339 A1 Jan. 31, 2019

(30) Foreign Application Priority Data

Jul. 31, 2017 (JP) ..... 2017-147636
Oct. 11, 2017 (JP) ..... 2017-198019

(51) Int. Cl.
*G09G 3/34* (2006.01)
*G09G 3/20* (2006.01)
*G09G 3/36* (2006.01)

(52) U.S. Cl.
CPC ..... *G09G 3/3426* (2013.01); *G09G 3/2007* (2013.01); *G09G 3/3648* (2013.01); *G09G 2300/023* (2013.01); *G09G 2300/0426* (2013.01)

(58) Field of Classification Search
None
See application file for complete search history.

(56) References Cited

U.S. PATENT DOCUMENTS 7,528,810 B2 * 5/2009 Ohshima ..... G09G 3/3233 345/76
8,482,509 B2 * 7/2013 Choe ..... G09G 3/342 345/102
8,638,339 B2 * 1/2014 Choe ..... G09G 3/342 345/102
8,803,790 B2 * 8/2014 Wasinger ..... G09G 3/3413 345/102
8,982,038 B2 * 3/2015 Higgins ..... G09G 3/3413 345/102

(Continued)

FOREIGN PATENT DOCUMENTS

JP 2015-191053 A 11/2015
JP 2017-207581 A 11/2017

*Primary Examiner* — Chad M Dicke
(74) *Attorney, Agent, or Firm* — K&L Gates LLP

(57) ABSTRACT

According to an aspect, a display device includes a display panel comprising a plurality of pixels, a light guide plate, a light source configured to emit light from a lateral side of the light guide plate, a dimming panel, and a controller. The dimming panel comprises a plurality of dimming areas arranged in an emission direction of the light from the light source. The dimming areas are capable of individually changing transmittance of the light according to intensities of light required to display an image using the display panel. When adjacent two of the dimming areas differ in light transmittance from each other, the controller increases output gradation values of target pixels, the target pixels being located in a predetermined area extending from a boundary between the two dimming areas in one of the two dimming areas that has lower light transmittance.

8 Claims, 30 Drawing Sheets

(56) References Cited

U.S. PATENT DOCUMENTS

| | | | | |
|---|---|---|---|---|
| 9,818,346 | B2 * | 11/2017 | Tamaru | G09G 3/3426 |
| 10,019,785 | B2 * | 7/2018 | Hsu | G06T 5/009 |
| 10,109,243 | B2 * | 10/2018 | Kang | H05B 33/0827 |
| 10,147,365 | B2 * | 12/2018 | Jeon | G09G 3/3688 |
| 2006/0145976 | A1 * | 7/2006 | Tsai | G02F 1/13306 345/87 |
| 2007/0247871 | A1 * | 10/2007 | Yoo | G02B 6/0021 362/612 |
| 2008/0180414 | A1 * | 7/2008 | Fung | G09G 3/3426 345/204 |
| 2008/0278432 | A1 * | 11/2008 | Ohshima | G09G 3/342 345/102 |
| 2009/0153591 | A1 * | 6/2009 | Shin | G09G 5/10 345/690 |
| 2010/0039440 | A1 * | 2/2010 | Tanaka | G09G 3/342 345/589 |
| 2011/0141090 | A1 * | 6/2011 | Hong | G09G 3/3426 345/211 |
| 2011/0148941 | A1 * | 6/2011 | Kim | G09G 3/3426 345/690 |
| 2011/0285758 | A1 * | 11/2011 | Matsushita | G09G 3/3426 345/690 |
| 2012/0075326 | A1 * | 3/2012 | Tsuchiya | G02B 6/0058 345/589 |
| 2012/0206502 | A1 * | 8/2012 | Jung | G09G 3/342 345/690 |
| 2016/0365038 | A1 * | 12/2016 | Min | G09G 3/2092 |
| 2017/0336676 | A1 | 11/2017 | Harada et al. | |
| 2018/0122283 | A1 * | 5/2018 | Kim | G09G 3/2003 |
| 2019/0005872 | A1 * | 1/2019 | Newton | G09G 3/3208 |

* cited by examiner

DISPLAY DEVICE WITH DIMMING PANEL

CROSS-REFERENCE TO RELATED APPLICATIONS

This application claims priority from Japanese Application No. 2017-147636, filed on Jul. 31, 2017 and Japanese Application No. 2017-198019, filed on Oct. 11, 2017, the contents of which are incorporated by reference herein in its entirety.

BACKGROUND

1. Technical Field

The present invention relates to a display device.

2. Description of the Related Art

In display devices illuminated by light from a back surface side thereof, a configuration is known in which an additional panel capable of controlling the transmittance of the light is provided between a display panel and a light source in order to reduce leakage of the light, as described in Japanese Patent Application Laid-open Publication No. 2015-191053.

Such an additional panel may have partial regions that are individually controlled in transmittance. If the transmittance differs between adjacent partial regions of this additional panel, a difference in light quantity occurs corresponding to the difference in the transmittance. Such a difference in light quantity is viewed as a belt-like halo along the position between the adjacent partial regions, in some cases. Such a belt-like halo causes problems, such as a reduction in contrast and deterioration in display quality.

SUMMARY

According to an aspect, a display device includes: a display panel comprising a plurality of pixels; a light guide plate provided on a back surface side of the display panel; a light source configured to emit light from a lateral side of the light guide plate; a dimming panel provided on a display panel side of the light guide plate; and a controller configured to control operations of at least the display panel and the dimming panel. The dimming panel comprises a plurality of dimming areas arranged in an emission direction of the light from the light source. The dimming areas are capable of individually changing transmittance of the light according to intensities of light required to display an image using the display panel. When adjacent two of the dimming areas differ in light transmittance from each other, the controller increases output gradation values of target pixels, the target pixels being located in a predetermined area extending from a boundary between the two dimming areas in one of the two dimming areas that has lower light transmittance.

DETAILED DESCRIPTION

Figure 1:
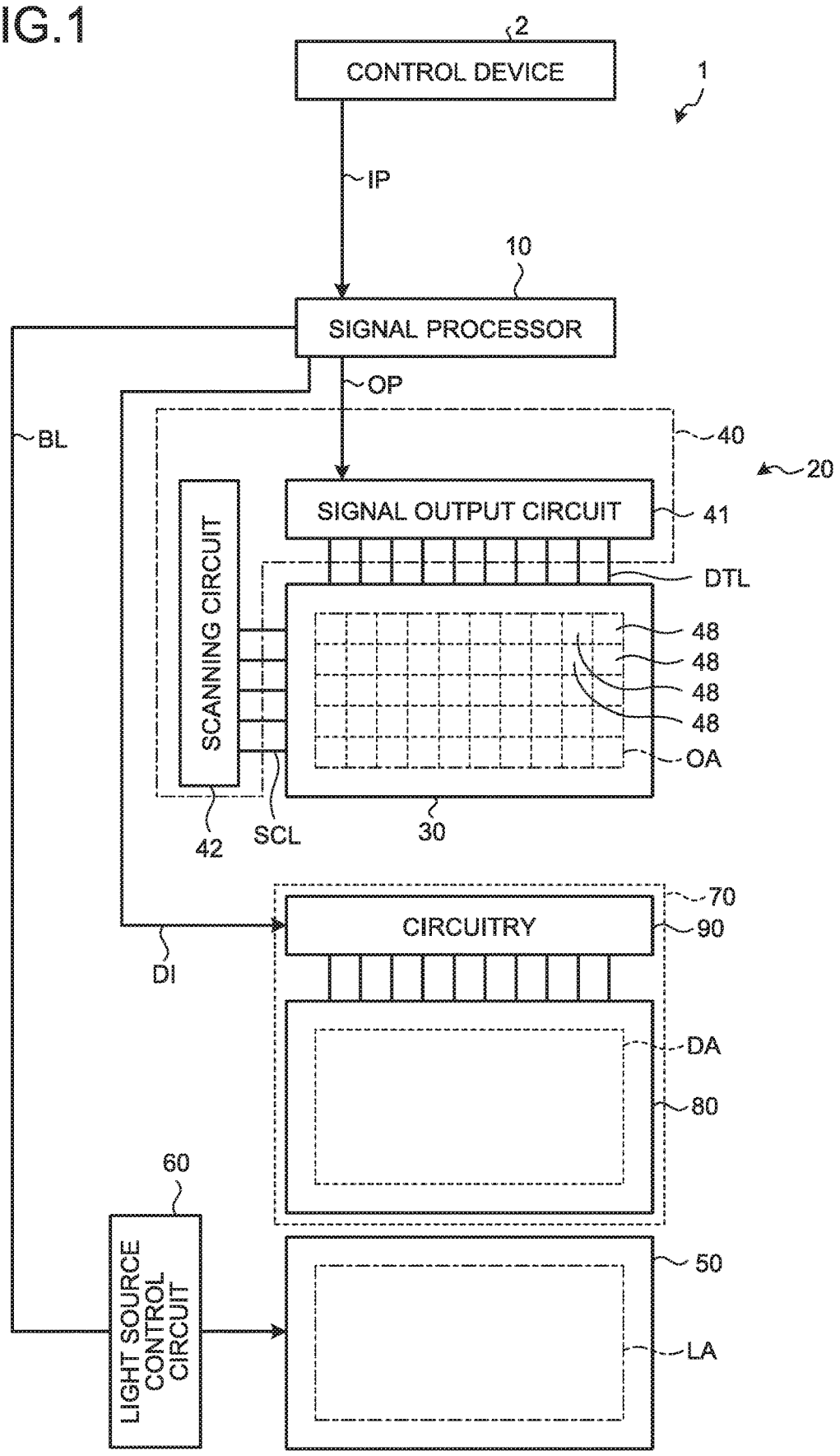
FIG. 1 is a diagram illustrating an exemplary main configuration of a display device according to a first embodiment of the present invention.

The following describes embodiments of the present invention with reference to the drawings. What is disclosed herein is merely an example, and the present invention naturally encompasses appropriate modifications easily conceivable by those skilled in the art while maintaining the gist of the invention. To further clarify the description, widths, thicknesses, shapes, and the like of various parts are schematically illustrated in the drawings as compared with actual aspects thereof, in some cases. However, they are merely examples, and interpretation of the present invention is not limited thereto. The same element as that illustrated in a drawing that has already been discussed is denoted by the same reference numeral through the description and the drawings, and detailed description thereof will not be repeated in some cases where appropriate.

In this disclosure, when an element is described as being "on" another element, the element can be directly on the other element, or there can be one or more elements between the element and the other element.

First Embodiment

FIG. 1 is a diagram illustrating an exemplary main configuration of a display device 1 according to the first embodiment of the present invention. The display device 1 of the first embodiment includes a signal processor 10, a display unit 20, a light source device 50, a light source control circuit 60, and a dimmer 70. The signal processor 10 performs various output operations based on input signals IP received from an external control device 2, and controls operations of the display unit 20, the light source device 50, and the dimmer 70. The input signals IP are signals serving as data for outputting an image for display on the display device 1, and are, for example, red, green, and blue (RGB) image signals. The signal processor 10 outputs output image signals OP generated based on the input signals IP to the display unit 20. The signal processor 10 outputs local dimming signals DI generated based on the input signals IP to the dimmer 70. After receiving the input signals IP, the signal processor 10 outputs light source drive signals BL for controlling lighting amounts (light quantities) of respective light sources 51 (refer to FIG. 7) included in the light source device 50 to the light source control circuit 60. The light source control circuit 60 is, for example, a driver circuit for lighting up the light sources 51 (refer to FIG. 7) included in the light source device 50, and operates the light source device 50 according to the light source drive signals BL.

The display unit 20 includes an image display panel 30 and an image display panel driver 40. The image display panel 30 includes a display area OA provided with pixels 48. The pixels 48 are arranged, for example, in a matrix (row-column configuration). The image display panel 30 of the first embodiment is a liquid crystal image display panel. The image display panel driver 40 includes a signal output circuit 41 and a scanning circuit 42. The signal output circuit 41 drives the pixels 48 according to the output image signals OP. The scanning circuit 42 outputs a drive signal for scanning the pixels 48 arranged in a matrix on a per predetermined number of lines basis (such as on a per row basis). The pixels 48 are driven so as to output gradation values corresponding to the output image signals OP at the time when the drive signal is output.

The dimmer 70 adjusts the quantity of light emitted from the light source device 50 and output through the display area OA. The dimmer 70 includes a dimming panel 80 and circuitry 90. The dimming panel 80 includes a local dimming area DA capable of changing the transmittance of the light. The local dimming area DA is disposed in a position overlapping the display area OA when the display area OA is viewed in a plan view. The local dimming area DA covers the entire display area OA in the plan view. The local dimming area DA includes a plurality of dimming areas LD (refer to FIG. 9). The circuitry 90 individually controls the transmittance of each of the dimming areas LD according to the local dimming signals DI.

Figure 2:
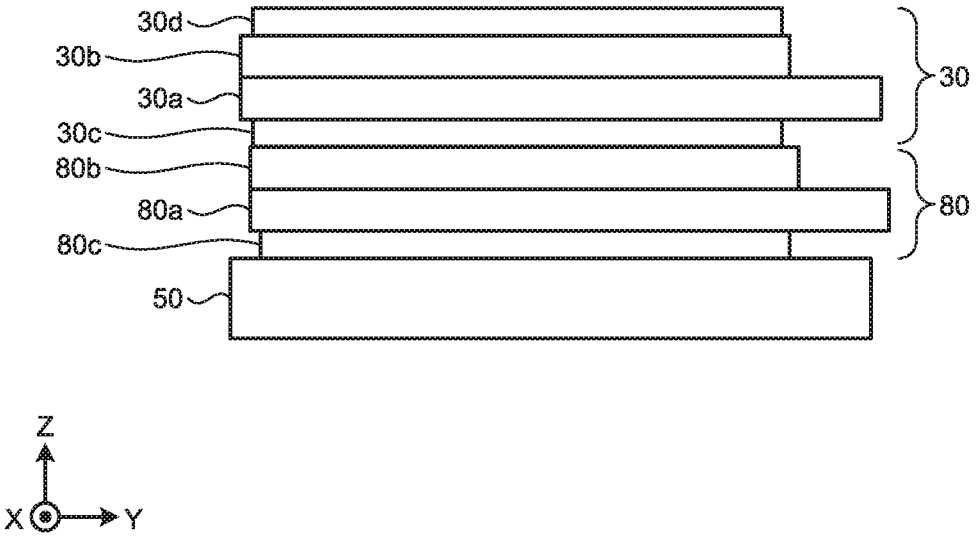
FIG. 2 is a diagram illustrating an exemplary positional relation of an image display panel, a dimming panel, and a light source device.

FIG. 2 is a diagram illustrating an exemplary positional relation of the image display panel 30, the dimming panel 80, and the light source device 50. In the first embodiment, as illustrated in FIG. 2, the image display panel 30, the dimming panel 80, and the light source device 50 are layered. Specifically, the dimming panel 80 is stacked on a light-emitting surface side of the light source device 50 from which the light is emitted. The image display panel 30 is stacked on the light source device 50 with the dimming panel 80 therebetween. The light emitted from the light source device 50 is adjusted in light quantity in the local dimming area DA of the dimming panel 80, and illuminates the image display panel 30. The image display panel 30 is illuminated from a back surface side thereof where the light source device 50 lies, and outputs the image for display to a side (display surface side) opposite to the back surface side. In this manner, the light source device 50 serves as a backlight that illuminates the display area OA of the image display panel 30 from the back surface thereof. In the first embodiment, the dimming panel 80 is provided between the image display panel 30 and the light source device 50. Hereinafter, the Z-direction refers to the direction in which the image display panel 30, the dimming panel 80, and the light source device 50 are layered. The X-direction and the Y-direction refer to two directions orthogonal to the Z-direction. The X-direction and the Y-direction are orthogonal to each other. The pixels 48 are arranged in a matrix along the X- and Y-directions. In the following description, h denotes the number of the pixels 48 arranged in the X-direction, and v denotes the number of the pixels 48 arranged in the Y-direction. A notation (h) represents a case where coordinate management in the X-direction is performed corresponding to positions of the pixels 48 arranged in the X-direction. A notation (v) represents a case where the coordinate management in the Y-direction is performed corresponding to positions of the pixels 48 arranged in the Y-direction. A notation (h,v) represents a case where the coordinate management in the X-direction and the Y-direction is performed corresponding to the positions of the pixels 48 arranged in the X-direction and the Y-direction.

The image display panel 30 includes an array substrate 30*a* and a counter substrate 30*b* that is located on a display surface side of the array substrate 30*a* and faces the array substrate 30*a*. As will be described later, a liquid crystal layer LC1 is disposed between the array substrate 30*a* and the counter substrate 30*b* (refer to FIG. 5). A polarizing plate 30*c* is provided on a back surface side of the array substrate 30*a*. A polarizing plate 30*d* is provided on a display surface side of the counter substrate 30*b*. The dimming panel 80 includes a first substrate 80*a* and a second substrate 80*b* that is located on a display surface side of the first substrate 80*a* and faces the first substrate 80*a*. As will be described later, a liquid crystal layer LC2 is disposed between the first substrate 80*a* and the second substrate 80*b* (refer to FIG. 12). A polarizing plate 80*c* is provided on a back surface side of the first substrate 80*a*. The polarizing plate 30*c* polarizes light both on the back surface side of the image display panel 30 and on a display surface side of the dimming panel 80.

Figure 3:
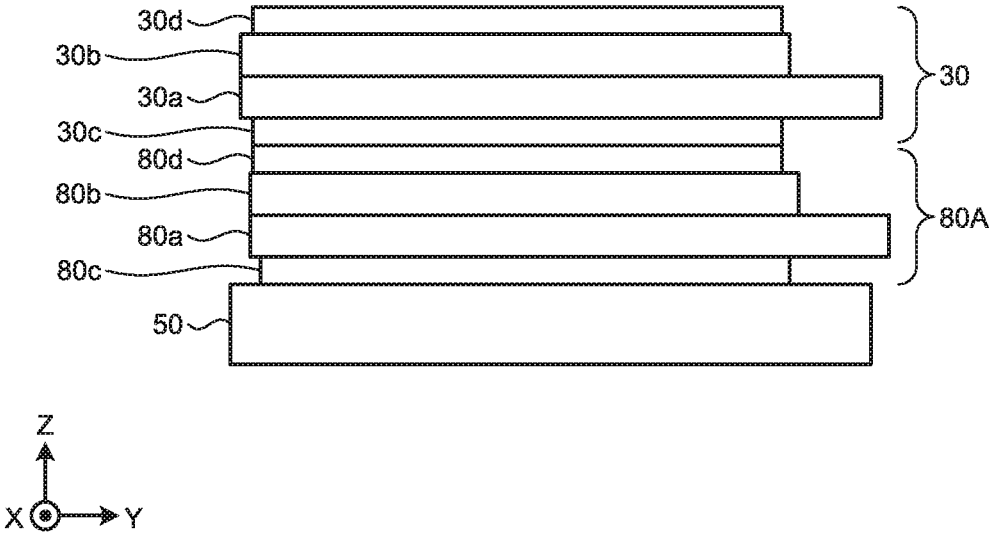
FIG. 3 is a diagram illustrating an example in which a polarizing plate is provided on a display surface side of the dimming panel.

FIG. 3 is a diagram illustrating an example in which a polarizing plate 80*d* is provided on the display surface side of the dimming panel 80. As illustrated in FIG. 3, the polarizing plate 80*d* may be provided on a display surface side of the second substrate 80*b*.

Figure 4:
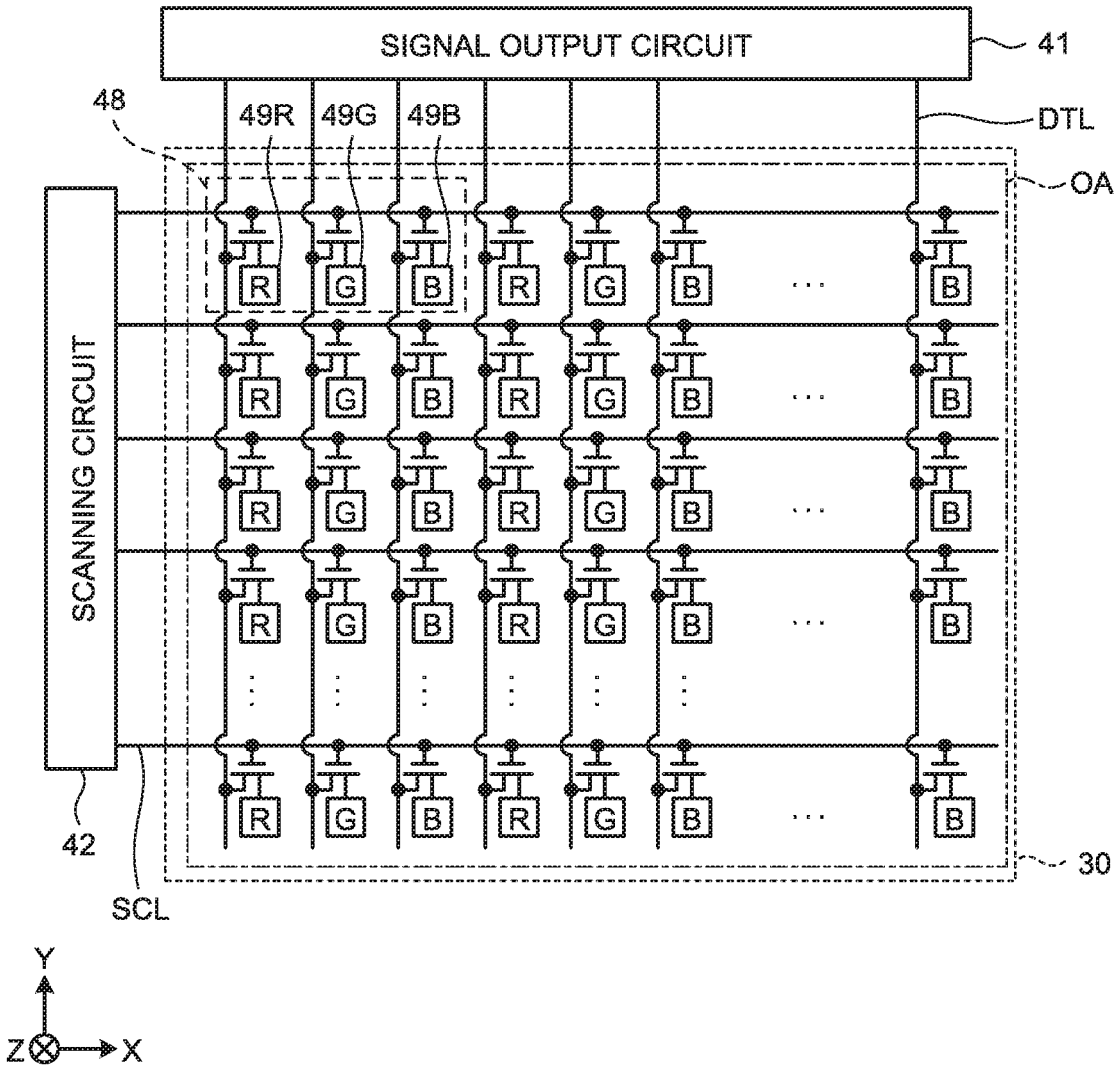
FIG. 4 is a diagram illustrating an exemplary pixel array of the image display panel.

FIG. 4 is a diagram illustrating an exemplary pixel array of the image display panel 30. As illustrated in FIG. 4, each of the pixels 48 includes, for example, a first sub-pixel 49R, a second sub-pixel 49G, and a third sub-pixel 49B. The first sub-pixel 49R displays a first primary color (for example, red). The second sub-pixel 49G displays a second primary color (for example, green). The third sub-pixel 49B displays a third primary color (for example, blue). In this manner, each of the pixels 48 arranged in a matrix (in a row-column configuration) in the image display panel 30 includes the first sub-pixel 49R that displays a first color, the second sub-pixel 49G that displays a second color, and the third sub-pixel 49B that displays a third color. The first color, the second color, and the third color are not limited to the first primary color, the second primary color, and the third primary color, but only need to be different colors from one another, such as complementary colors. In the following description, the first sub-pixel 49R, the second sub-pixel 49G, and the third sub-pixel 49B will be each called a sub-pixel 49 when not necessary to be distinguished from one another.

Each of the pixels 48 may further include the sub-pixel 49, in addition to the first sub-pixel 49R, the second sub-pixel 49G, and the third sub-pixel 49B. For example, the pixel 48 may include a fourth sub-pixel that displays a fourth color. The fourth sub-pixel displays a fourth color (for example, white). The fourth sub-pixel is preferably brighter than the first sub-pixel 49R that displays the first color, the second sub-pixel 49G that displays the second color, and the third sub-pixel 49B that displays the third color, when irradiated with the same light source lighting amount.

The display device 1 is more specifically a transmissive color liquid crystal display device. As illustrated in FIG. 4, the image display panel 30 is a color liquid crystal display panel, in which a first color filter for transmitting the first primary color is disposed between the first sub-pixel 49R and an image viewer, a second color filter for transmitting the second primary color is disposed between the second sub-pixel 49G and the image viewer, and a third color filter for transmitting the third primary color is disposed between the third sub-pixel 49B and the image viewer. A filter film 26 (to be described later) has a configuration including the first color filter, the second color filter, and the third color filter.

In the case where the fourth sub-pixel is provided, no color filter is disposed between the fourth sub-pixel and the image viewer. In this case, a large level difference is generated at the fourth sub-pixel. In view of this, a transparent resin layer instead of the color filter may be provided on the fourth sub-pixel. This configuration can restrain the generation of the large level difference in the fourth sub-pixel.

The signal output circuit 41 is electrically coupled to the image display panel 30 through signal lines DTL. The image display panel driver 40 uses the scanning circuit 42 to select the sub-pixel 49 in the image display panel 30 and to control ON and OFF of a switching element (such as a thin-film transistor (TFT)) for controlling operations (light transmittance) of the sub-pixel 49. The scanning circuit 42 is electrically coupled to the image display panel 30 through scanning lines SCL. In the first embodiment, the scanning lines SCL extend along the X-direction, and the signal lines DTL extend along the Y-direction. These are, however, mere examples of extension directions of the scanning lines SCL and the signal lines DTL. The extension directions are not limited thereto, and can be changed as appropriate.

Figure 5:
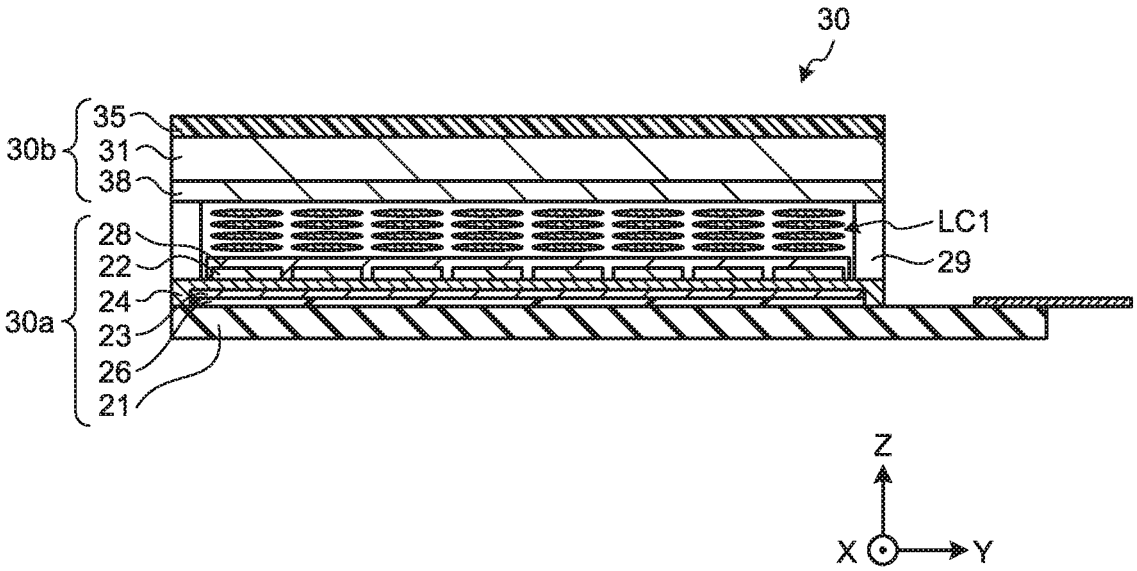
FIG. 5 is a schematic diagram illustrating an exemplary sectional structure of the image display panel.

FIG. 5 is a schematic diagram illustrating an exemplary sectional structure of the image display panel 30. The array substrate 30*a* includes the filter film 26, a counter electrode 23, an insulating film 24, pixel electrodes 22, and a first orientation film 28. The filter film 26 is provided on a pixel substrate 21, such as a glass substrate. The counter electrode 23 is provided on the filter film 26. The insulating film 24 is provided directly on the counter electrode 23 so as to be in contact therewith. The pixel electrodes 22 are provided on the insulating film 24. The first orientation film 28 is provided on the uppermost surface side of the array substrate 30*a*. The counter substrate 30*b* includes a counter pixel substrate 31, such as a glass substrate, a second orientation film 38 provided on the lower surface of the counter pixel substrate 31, and a polarizing plate 35 provided on the upper surface thereof. The array substrate 30*a* is fixed to the counter substrate 30*b* with a sealing part 29 interposed therebetween. The liquid crystal layer LC1 is sealed in a space surrounded by the array substrate 30*a*, the counter substrate 30*b*, and the sealing part 29. The liquid crystal layer LC1 contains liquid crystal molecules that change in orientation direction according to an electric field applied thereto. The liquid crystal layer LC1 modulates light passing through the inside of the liquid crystal layer LC1 according to the state of the electric field. The electric field applied between the pixel electrodes 22 and the counter electrode 23 changes the orientations of the liquid crystal molecules of the liquid crystal layer LC1, and thus changes the transmission amount of the light passing through the liquid crystal layer LC1. The sub-pixels 49 include the respective pixel electrodes 22. The switching elements for individually controlling the operations (light transmittance) of the sub-pixels 49 are electrically coupled to the pixel electrodes 22.

Figure 6:
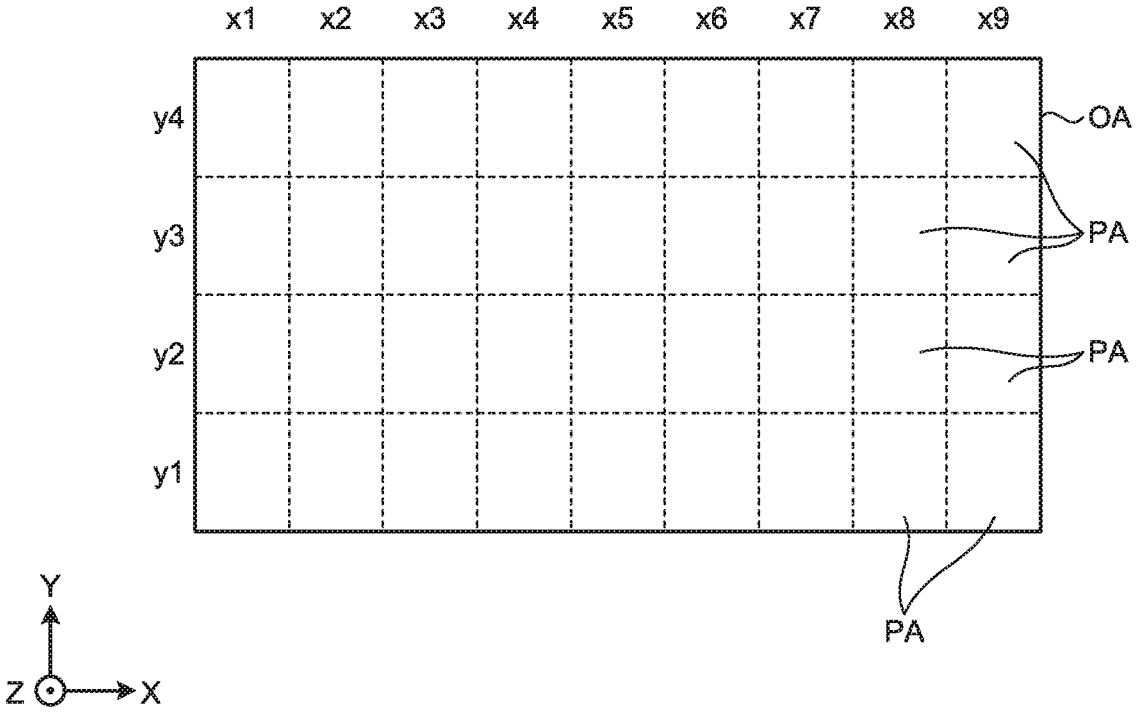
FIG. 6 is a diagram illustrating an exemplary relation between a display area and display segment regions.

FIG. 6 is a diagram illustrating an exemplary relation between the display area OA and display segment regions. The display area OA includes a plurality of display segment regions PA. The display area OA is an area obtained by combining the display segment regions PA. The display area OA illustrated in FIG. 6 includes the display segment regions PA that are individually provided in positions corresponding to a total of 36 sets of coordinates corresponding to combinations of coordinates x1, x2, . . . , and x9 set along the X-direction and coordinates y1, y2, y3, and y4 set along the Y-direction. Hereinafter, in some cases, coordinates will be used to indicate positions of, for example, the display segment regions PA. For example, "display segment regions PA at (x1)" represent the display segment regions PA provided in positions having a coordinate of x1 in the X-direction; "display segment regions PA at (y1)" represent the display segment regions PA provided in positions having a coordinate of y1 in the Y-direction; and a "display segment region PA at (x1,y1)" represents the display segment region PA provided in a position having a coordinate of x1 in the X-direction and a coordinate of y1 in the Y-direction. Positions of the light sources 51 and of light source regions GA and the dimming areas LD (both to be described later) will be indicated using the same kind of expression in some cases.

Figure 7:
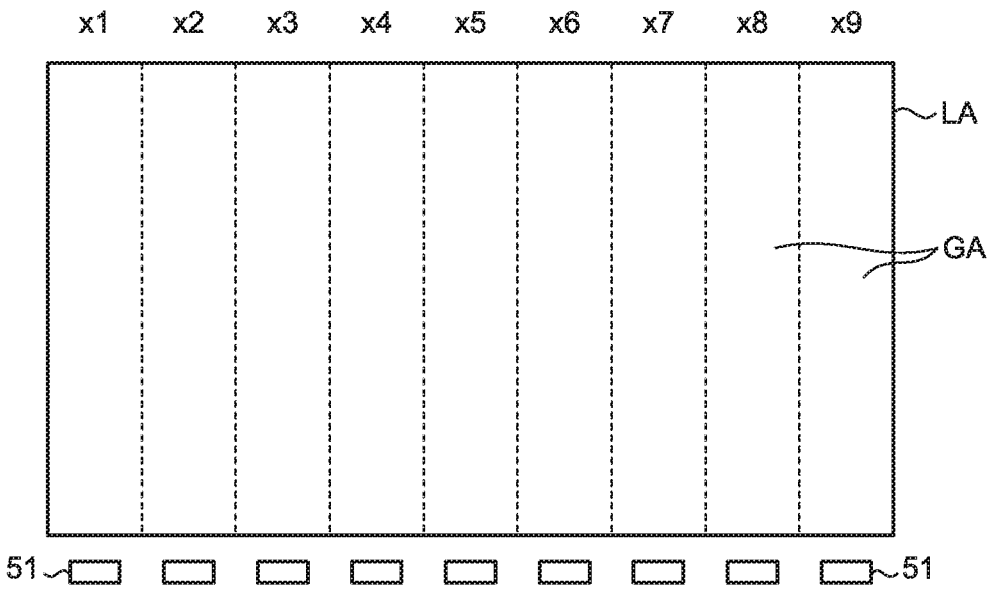
FIG. 7 is a diagram illustrating an exemplary main configuration of the light source device.

Of the coordinates of the display segment regions PA included in the display area OA, the coordinates in the X-direction correspond to the number of the light sources 51 included in the light source device 50 and the positions in the X-direction of the respective light sources 51 (refer to FIG. 7). Of the coordinates of the display segment regions PA included in the display area OA, the coordinates in the Y-direction correspond to the number of the dimming areas included in the dimming panel 80 and the positions in the Y-direction of the respective dimming areas (refer to FIG. 9).

FIG. 7 is a diagram illustrating an exemplary main configuration of the light source device 50. The light source device 50 includes, for example, a light guide plate LA and the light sources 51. The light guide plate LA is provided in a position corresponding to the display area OA in an XY-planar view on the back surface side of the image display panel 30. The light sources 51 are arranged in the X-direction on one end side in the Y-direction. The light sources 51 emit light from a lateral side of the light guide plate LA. The light sources 51 are, for example, light-emitting diodes (LEDs) emitting white light, but are not limited thereto, and can be changed as appropriate. The light from the light sources 51 is guided by the light guide plate LA, and illuminates the entire display area OA from the back surface side thereof.

In the example illustrated in FIG. 7, the light sources 51 are individually arranged corresponding to the coordinates (x1, x2, . . . , and x9) in the X-direction. The light guide plate LA includes the light source regions GA provided corresponding to the coordinates (x1, x2, . . . , and x9) in the X-direction. When the light is emitted from the light sources 51, the light source regions GA guide the light so as to illuminate the image display panel 30 from the back surface side of the display segment regions PA corresponding to the coordinates in the X-direction of the light source regions GA. The light source regions GA are assumed to guide the light from the respective light sources 51 at the corresponding coordinates (x1, x2, . . . , and x9) in the X-direction. The following description of the lighting amount control of the light sources 51 will be given on the assumption that the light is emitted from the light sources 51 at the coordinates (x1, x2, . . . , and x9) in the X-direction corresponding to the light source regions GA.

Each light source region GA can receive not only light from the light source 51 at a corresponding one of the coordinates (x1, x2, . . . , and x9) in the X-direction but also light from the light sources at other coordinates in the X-direction not corresponding to the light source region GA. A lighting amount calculator 104 (refer to FIG. 23) to be described later may have reference data for obtaining a relation between a luminance distribution of the light source regions GA and the lighting amount of each of the light sources 51 including that of the light from the light sources 51 at such non-corresponding coordinates. If having the reference data, the lighting amount calculator 104 uses the reference data when calculating the lighting amount of each of the light sources 51.

In the first embodiment, the light sources 51 emit the light from one end side of the light guide plate LA. Specifically, in the first embodiment, as illustrated, for example, in FIG. 7, nine light sources 51 are provided, being arranged in a line along the X-direction on one end side in the Y-direction. The example illustrated in FIG. 7 is a mere example of the number and the arrangement of the light sources 51, which are not limited to this example, and can be changed as appropriate.

Figure 8:
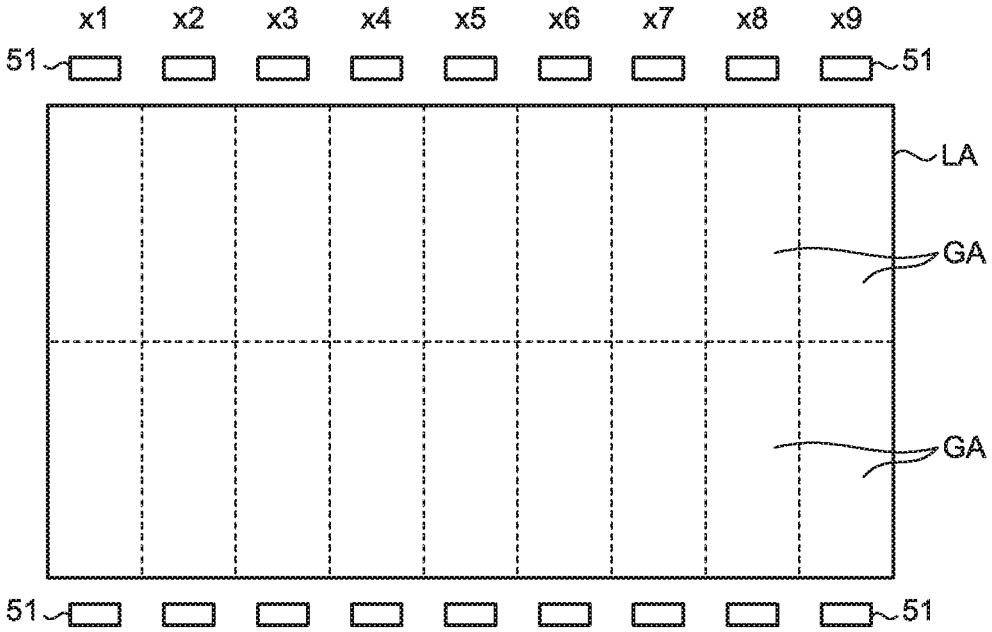
FIG. 8 is a diagram illustrating another exemplary configuration of the light source device.

FIG. 8 is a diagram illustrating another exemplary configuration of the light source device 50. For example, as illustrated in FIG. 8, a total of 18 light sources 51 may be disposed, being arranged in a line along the X-direction on each of one end side and the other end side in the Y-direction. In this manner, the display device 1 may include the light sources 51 provided in positions opposed to one another across the light guide plate LA.

Figure 9:
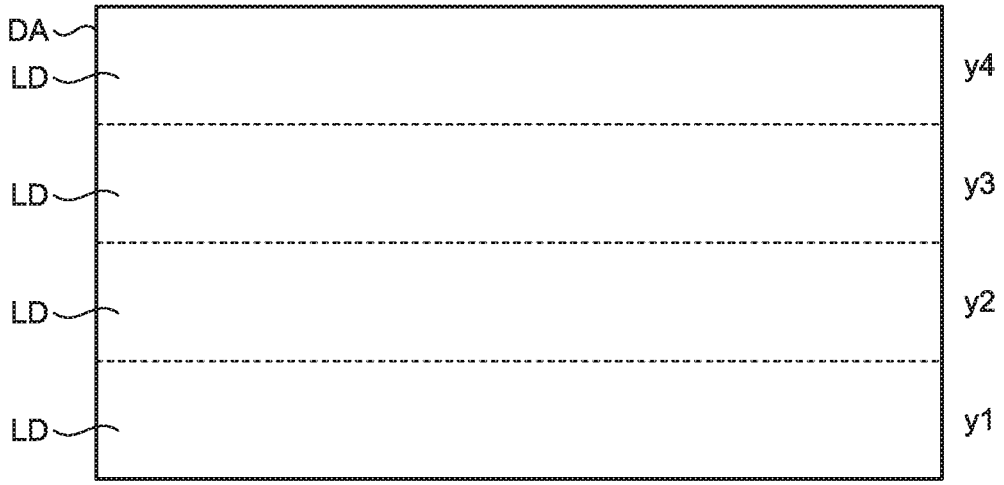
FIG. 9 is a diagram illustrating an exemplary relation between dimming areas included in the dimming panel and coordinates in the Y-direction of the dimming areas.

FIG. 9 is a diagram illustrating an exemplary relation between the dimming areas LD included in the dimming panel 80 and the coordinates in the Y-direction of the dimming areas LD. The dimming panel 80 includes the dimming areas LD capable of individually controlling the transmittance of the light. The local dimming area DA is an area including the dimming areas LD. The dimming panel 80 is provided such that each of the dimming areas LD can individually control the transmittance of the light guided by the light guide plate LA and illuminating the entire display area OA from the bask surface side thereof. Thus, the dimming areas LD of the first embodiment extend in a direction (such as the X-direction) intersecting an emission direction (such as the Y-direction) of the light from the light sources 51 to the light guide plate LA. In the example illustrated in FIG. 9, four dimming areas LD arranged in the Y-direction are provided. The positions of the four dimming areas LD correspond to the coordinates (y1, y2, y3, and y4) in the Y-direction. The number of the dimming areas LD illustrated in FIG. 9 is a mere example, and is not limited thereto, but can be changed as appropriate.

As described above, each of the display segment regions PA arranged in the X-direction is irradiated with light from the light source region GA at a corresponding coordinate in the X-direction. Each of the display segment regions PA arranged in the Y-direction is controlled in the level of irradiation with the light from a corresponding one of the light source regions GA by the dimming area LD at a corresponding one of the coordinates in the Y-direction.

Figure 10:
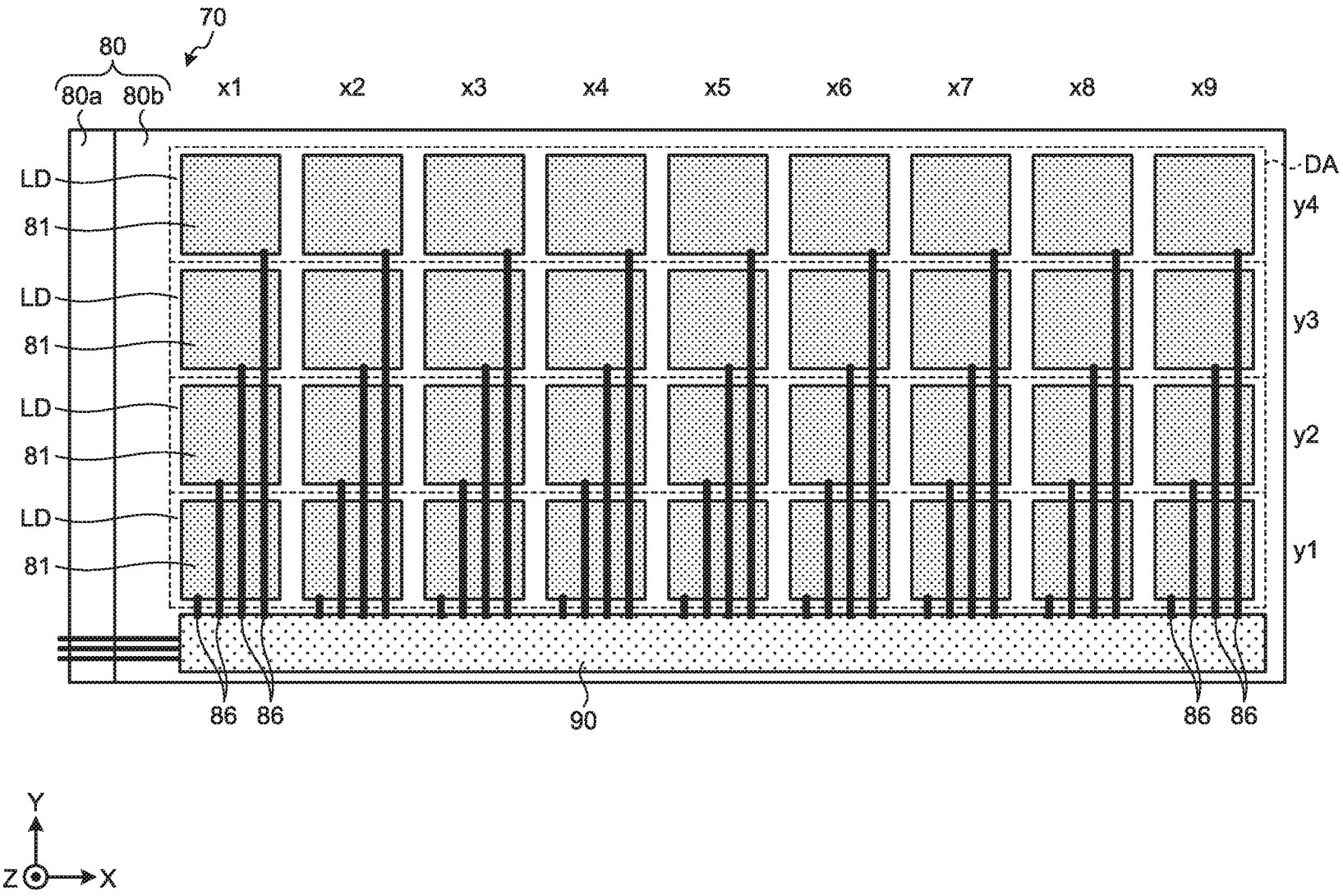
FIG. 10 is a diagram illustrating an exemplary main configuration of a dimmer.

FIG. 10 is a diagram illustrating an exemplary main configuration of the dimmer 70. The dimming panel 80 includes a plurality of first electrodes 81 provided in the local dimming area DA. The dimming panel 80 illustrated in FIG. 10 includes the first electrodes 81 individually provided in positions corresponding to 36 sets of coordinates, for example, corresponding to the combinations of the coordinates x1, x2, . . . , and x9 set along the X-direction and the coordinates y1, y2, y3, and y4 set along the Y-direction. Each of the first electrodes 81 is coupled to the circuitry 90 through wiring 86.

The circuitry 90 of the first embodiment controls, for example, potentials of the first electrodes 81 at the same coordinate in the Y-direction so as to be uniform according to the local dimming signals DI. This control makes the transmittance of the dimming areas LD uniform in the longitudinal direction (X-direction). The circuitry 90 individually controls the potentials of the first electrodes 81 at different coordinates in the Y-direction. This control individually controls the transmittance of the dimming areas LD.

Figure 11:
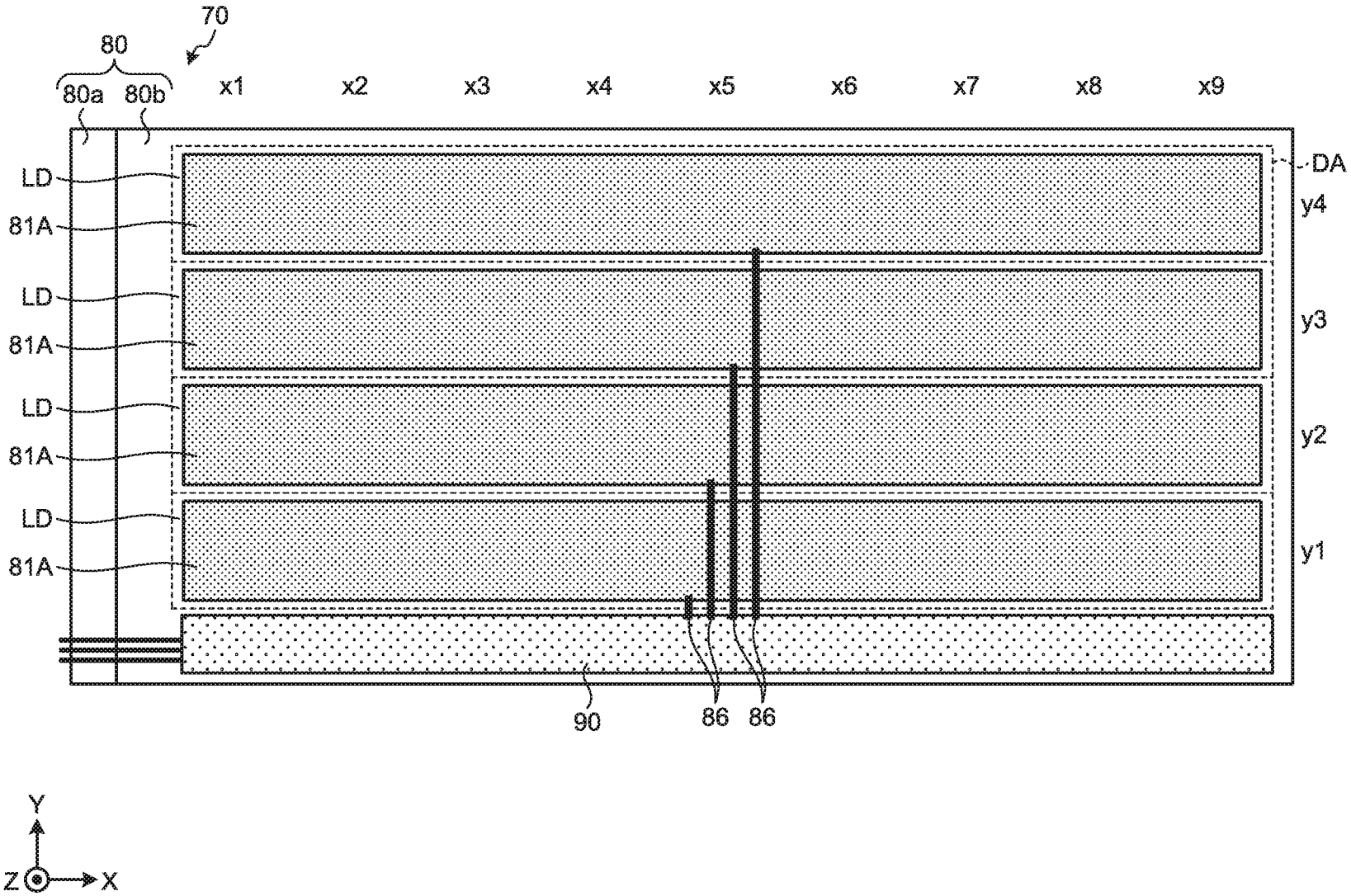
FIG. 11 is a diagram illustrating another exemplary main configuration of the dimmer.

FIG. 11 is a diagram illustrating another exemplary main configuration of the dimmer. In FIG. 10, the first electrodes 81 are provided in positions corresponding to the coordinates in the X-direction. This is a mere example of a specific way of providing the first electrodes 81. The specific way thereof is not limited to this example. For example, as illustrated in FIG. 11, first electrodes 81A may be provided corresponding one-to-one to the dimming areas LD. In this case, the length in the X-direction of each first electrode 81A provided in a corresponding one of the dimming areas LD corresponds to the length in the X-direction of the dimming area LD.

Figure 12:
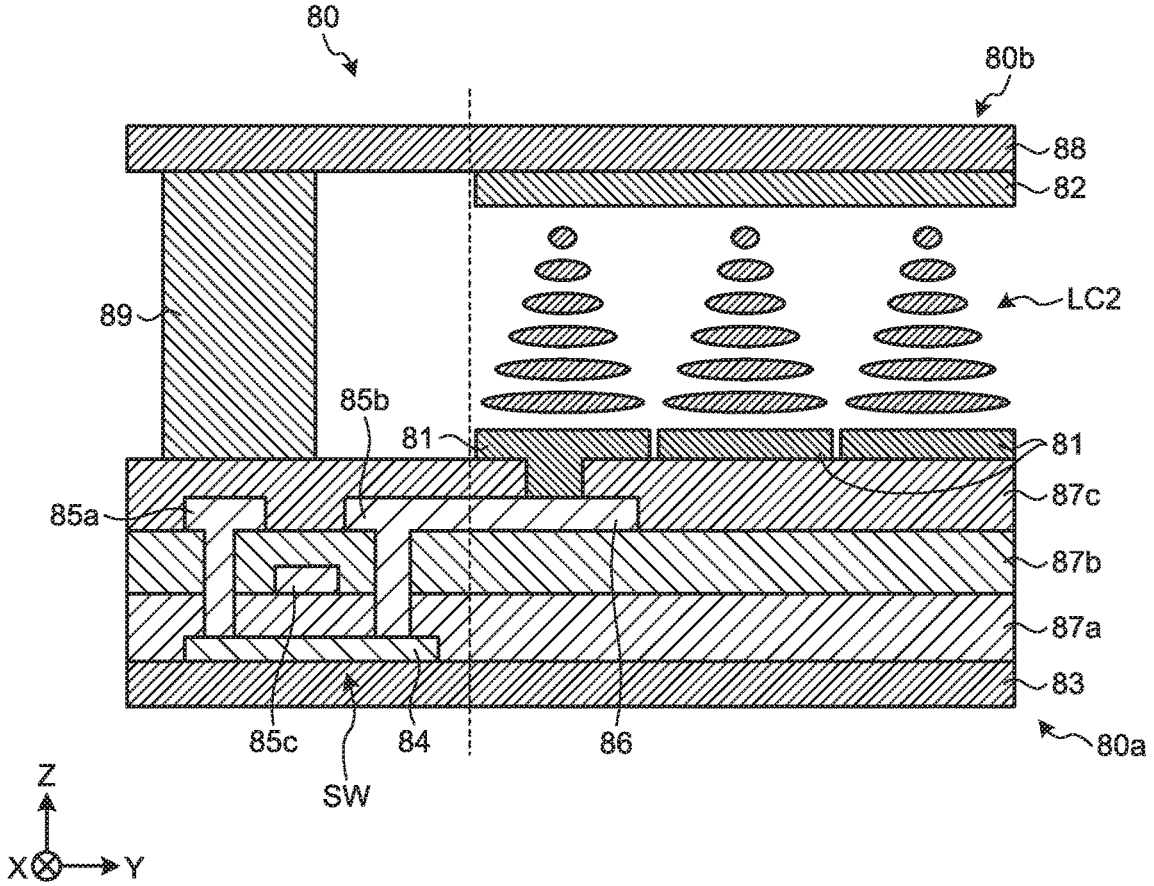
FIG. 12 is a schematic diagram illustrating an exemplary sectional structure of the dimming panel.

FIG. 12 is a schematic diagram illustrating an exemplary sectional structure of the dimming panel 80. The dimmer 70 includes switches SW made of, for example, a TFT. Each of the switches SW includes a channel 84, a source 85*a*, a drain 85*b*, and a gate 85*c* that are mounted on a first transparent substrate 83 of the first substrate 80*a*. The source 85*a* is supplied with a potential based on the local dimming signal DI, that is, a potential corresponding to the transmittance of each of the dimming areas LD. The drain 85*b* is electrically coupled to the wiring 86. The switch SW switches whether to conduct a drain current to a corresponding one of the first electrodes 81 according to whether a signal is applied to the gate 85*c*. Although FIG. 12 schematically illustrates an electrical coupling relation between one of the switches SW and one of the first electrodes 81, each of the first electrodes 81 may be coupled to the drain 85*b* of the individual switch SW through the individual wiring 86.

Each of the dimming areas LD includes corresponding ones of the first electrodes 81 and a second electrode 82 provided in a position opposed to the first electrodes 81 with the liquid crystal layer LC2 in between. Specifically, the first substrate 80*a* includes the first transparent substrate 83, the semiconductor layer (channel) 84, a first insulating layer 87*a*, a second insulating layer 87*b*, a third insulating layer 87*c*, and the first electrodes 81. The second insulating layer 87*b* is stacked on the gate 85*c* stacked on the first insulating layer 87*a*. The third insulating layer 87*c* is stacked on the source electrode 85*a* and the drain electrode 85*b*. The first electrodes 81 are stacked on the third insulating layer 87*c*. The second substrate 80*b* includes a second transparent substrate 88 and the second electrode 82 stacked on the second transparent substrate 88. The first substrate 80*a* and the second substrate 80*b* are disposed such that a surface provided with the first electrodes 81 is opposed to a surface provided with the second electrode 82. The liquid crystal layer LC2 is provided between the surface provided with the first electrodes 81 and the surface provided with the second electrode 82. A seal material 89 for sealing the liquid crystal layer LC2 is provided between the first substrate 80*a* and the second substrate 80*b*. The first transparent substrate 83 and the second transparent substrate 88 are, for example, glass substrates. The first electrodes 81, the second electrode 82, and the wiring 86 are translucent electrodes made of, for example, indium tin oxide (ITO).

The second electrode 82 of the first embodiment has a structure shared by the dimming areas LD. Specifically, the second electrode 82 is a flat film-like electrode provided so as to cover the entire local dimming area DA across the dimming areas LD. The potential of each of the first electrodes 81 in the dimming areas LD is individually controlled with respect to the potential of the second electrode 82 shared by the dimming areas LD, whereby the extent of twist of the liquid crystals in each of the dimming areas LD is individually controlled. This control individually controls the light transmittance levels of the respective dimming areas LD according to the local dimming signals DI.

The dimming panel 80 of the first embodiment is a twisted nematic (TN) liquid crystal panel, and transmits light at the maximum transmittance when no current flows therethrough (that is, normally white). This is a mere example of a specific form of the dimming panel 80, which is not limited to this example. The dimming panel 80 may be a liquid crystal panel of another type, and may be a normally black panel. The form of the second electrode 82 described above is a mere example of a specific form of the second electrode 82, which is not limited to this example, and can be changed as appropriate. For example, the second electrode 82 may be individually provided in each of the dimming areas LD in the same manner as the first electrode 81. In this case, potentials of the respective individually provided second electrodes 82 are controlled so as to be the same potential at the same time.

The circuitry 90 deals with electrical signals for controlling the transmittance of each of the dimming areas LD. The circuitry 90 is mounted using, for example, a chip-on-glass (COG) technique, for example, in a frame area of the dimming panel 80 of the dimmer 70 where the local dimming area DA is not located. The circuitry 90 is coupled to each of the first electrodes 81 through the wiring 86. In this manner, the circuit for individually controlling the transmittance of each of the dimming areas LD is provided outside the local dimming area DA. As a result, the maximum light transmittance in the local dimming area DA can be more easily increased.

Figure 13:
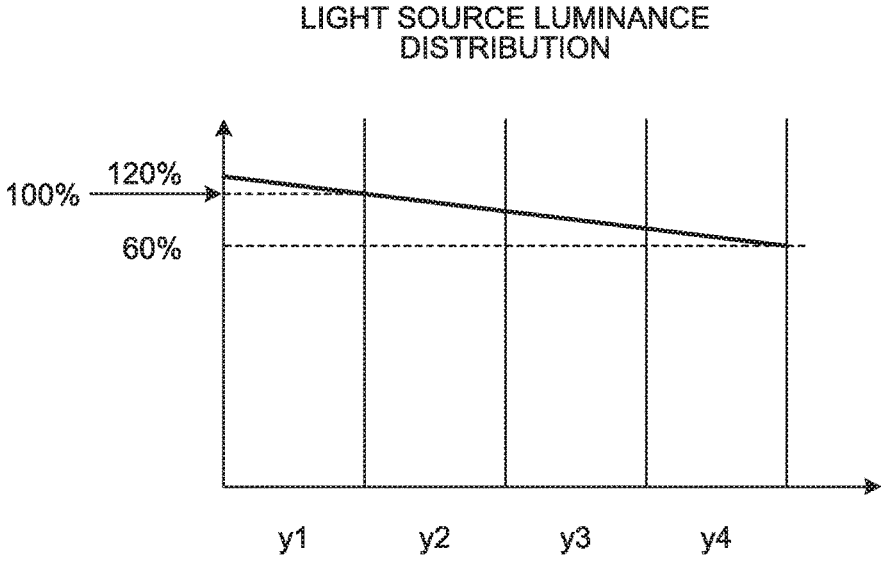
FIG. 13 is a diagram illustrating an exemplary luminance distribution (light source luminance distribution) obtained by light from a light source.
Figure 14:
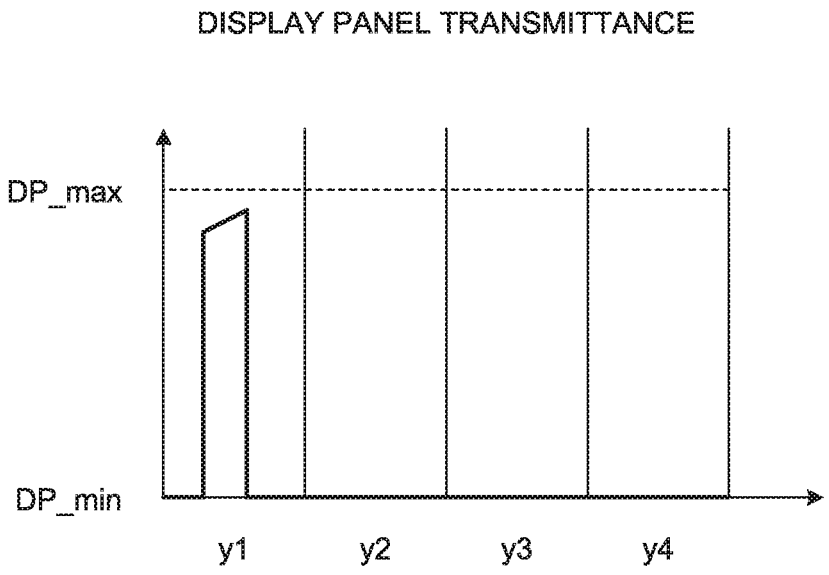
FIG. 14 is a diagram illustrating an example of transmittance of the image display panel that outputs an image under the condition that the light source luminance distribution illustrated in FIG. 13 is obtained.
Figure 15:
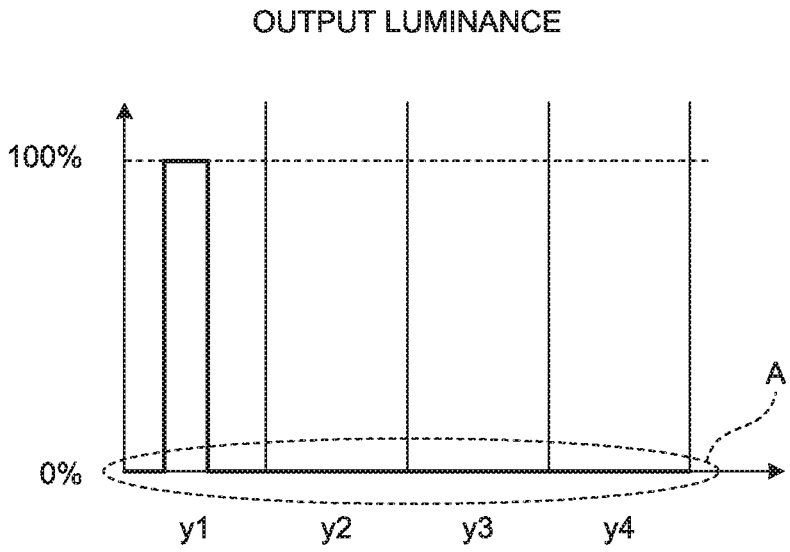
FIG. 15 is a diagram illustrating output luminance of the display device when the image display panel is operated so as to have the transmittance of the image display panel illustrated in FIG. 14 under the condition that the light source luminance distribution illustrated in FIG. 13 is obtained.

FIG. 13 is a diagram illustrating an exemplary luminance distribution (light source luminance distribution) obtained by the light from a light source. FIG. 14 is a diagram illustrating an example of the transmittance of the image display panel 30 that outputs the image under the condition that the light source luminance distribution illustrated in FIG. 13 is obtained. FIG. 15 is a diagram illustrating output luminance of the display device 1 when the image display panel 30 is operated so as to have the transmittance of the image display panel 30 illustrated in FIG. 14 under the condition that the light source luminance distribution illustrated in FIG. 13 is obtained. For example, as illustrated in FIG. 15, assume a case where one or more colors have output luminance corresponding to a gradation value of 100[%] in some of the display segment regions PA at (y1) closest in coordinates in the Y-direction to the light source 51. This case is assumed to be a case where the image is displayed in black ((R,G,B)=(0,0,0)) except in some of the display segment regions PA. In this case, the display segment regions PA at (y1) need to have luminance of 100[%] or higher. In the display segment regions PA at (y2), (y3), and (y4), all the gradation values of the pixels 48 included in the input signals IP are (R,G,B)=(0,0,0), and thus, no light is needed from the light sources 51. In this case, if luminance of 100[%] is ensured at the boundary between the display segment regions PA at (y1) and the display segment regions PA at (y2) as illustrated in FIG. 13, the output luminance of the display segment regions PA at (y1) can be sufficiently ensured. When the light source 51 is on, the light source 51 illuminates a closer position more brightly. As a result, the output luminance of the display segment regions PA at (y1) is higher than the luminance of the boundary between the display segment regions PA at (y1) and the display segment regions PA at (y2).

In FIG. 13, the light source 51 is lit at an intensity of 120[%] in order to ensure the luminance of 100[%] in the entire display segment regions PA at (y1). FIG. 13 illustrates that the luminance of the light decreases as the coordinate position is farther away from (y1) to y2, y3, and y4. FIG. 13 illustrates the example in which the luminance is 60[%] at an end in the Y-direction of the display segment regions PA at (y4) farthest from the light source 51. In consideration of the fact that the luminance of the light changes with the distance from the light source 51 in this manner, the transmittance of the image display panel 30 is multiplied by a gain based on the inverse of the luminance (inverse luminance gainpix(h, v) to be described later). Specifically, output gradation values of each of the pixels of the image display panel 30 are multiplied by the gain. In FIG. 14, the gain is multiplied so as to increase the transmittance of the image display panel 30 from one end side toward the other end side in response to the reduction in the luminance from one end side toward the other end side in FIG. 13. By combination of the luminance of the light from the light source 51 (FIG. 13) with the transmittance multiplied by the gain (refer to FIG. 14), the output luminance can be set to 100[%] in the display segment regions PA at (y1), as illustrated in FIG. 15.

As illustrated, for example, in FIG. 14, the image display panel 30 is capable of changing the transmittance within a range with maximum transmittance (DP_max) serving as the upper limit and minimum transmittance (DP_min) serving as the lower limit. When the gradation value of each of (R,G,B) is expressed by a predetermined number of bits (such as 8 bits of 0 to 255), the maximum transmittance (DP_max) is transmittance corresponding to the maximum gradation value (255) representable by the number of bits, and the minimum transmittance (DP_min) is transmittance corresponding to the minimum gradation value (0) representable by the number of bits. Hereinafter, a "first contrast (DP-c, refer to FIG. 21)" denotes a value related to the ratio between the maximum transmittance (DP_max) and the minimum transmittance (DP_min) of the image display panel 30. The first contrast represents the "contrast of the image display panel 30", and is given as, for example, DP_c=DP_max/DP_min. Assuming that DP_c=1000, the minimum transmittance (DP_min) of the image display panel 30 is 1/1000 of the maximum transmittance (DP_max) thereof. In other words, the light transmittance of the image display panel 30 is not zero at the minimum transmittance (DP_min).

Figure 16:
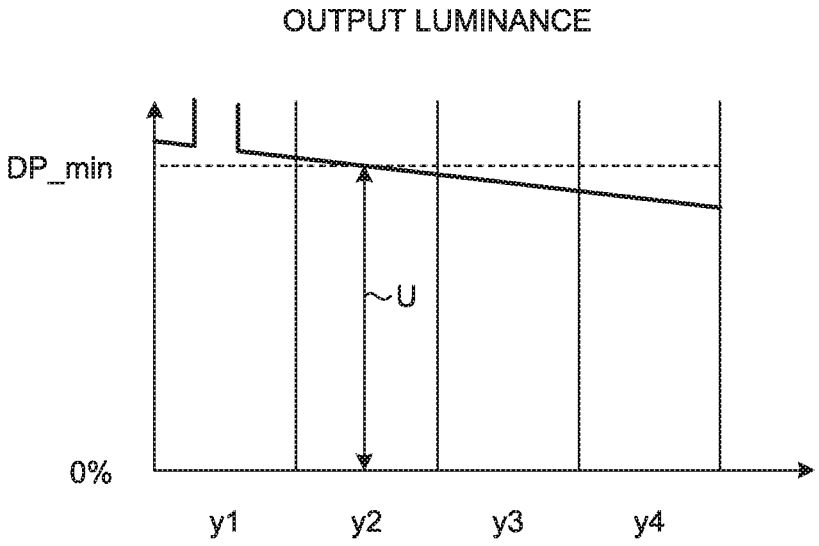
FIG. 16 is a schematic diagram obtained by magnifying a range A of FIG. 15 when reduction of luminance by the dimming panel is not taken into account.

FIG. 16 is a schematic diagram obtained by magnifying a range A of FIG. 15 when control of the contrast by the dimming panel 80 is not taken into account. As described above, the light transmittance of the image display panel 30 is not zero even at the minimum transmittance (DP_min). Therefore, if the dimming panel 80 is not provided, even when the pixels 48 are controlled so as to have the minimum transmittance (DP_min) corresponding to (R,G,B)=0, a phenomenon called black floating (insufficient black level caused by light leakage) U occurs corresponding to a gap in the output luminance between a state of completely no light (at 0[%] in the graph of FIG. 16) and the minimum transmittance (DP_min). As a specific example, an output luminance value of approximately 0.1[%] is obtained by the black floating U of the image display panel 30 having the first contrast of 1000.

Figure 17:
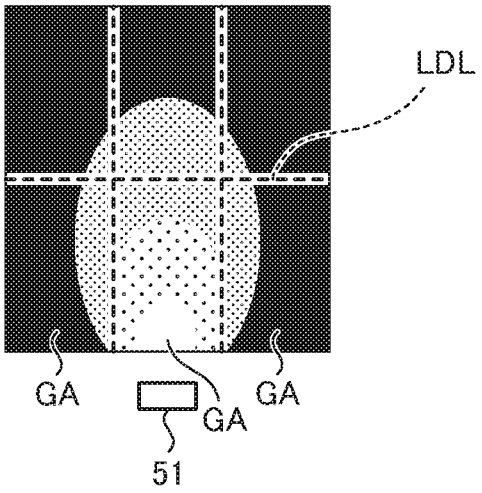
FIG. 17 is a schematic diagram illustrating an example of the area that light from the light source reaches.

FIG. 17 is a schematic diagram illustrating an example of the area that light from the light source 51 reaches. A boundary line LDL between the adjacent dimming areas is illustrated in FIG. 17 and other figures. As described with reference to FIG. 13, the luminance of the light from the light source 51 decreases as the distance from the light source 51 increases. Hence, the degree of the black floating U also changes with the distance from the light source 51, as illustrated in the graph of FIG. 16 and the schematic diagram of FIG. 17. The black floating U described above is known as what is called a halo effect.

Figure 18:
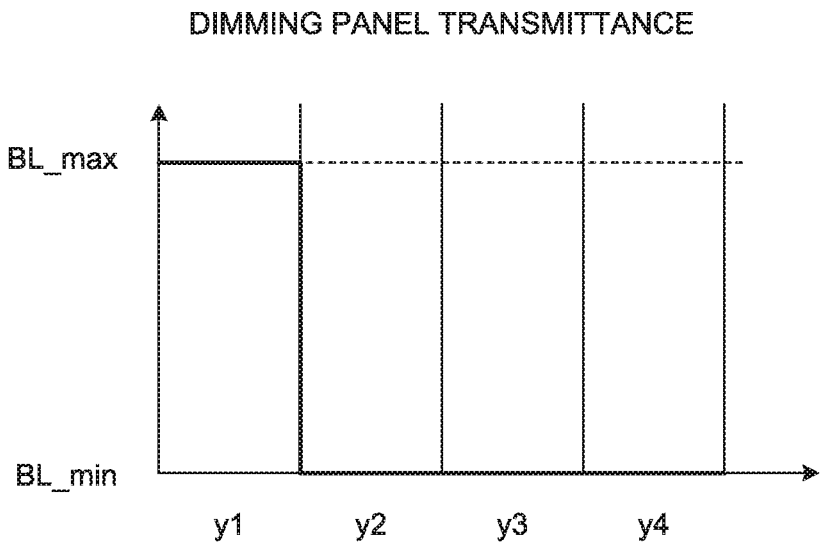
FIG. 18 is a diagram illustrating an example of transmittance of the dimming panel.

FIG. 18 is a diagram illustrating an example of the transmittance of the dimming panel 80. The dimming panel 80 is capable of changing the transmittance within a range with maximum transmittance (BL_max) serving as the upper limit and minimum transmittance (BL_min) serving as the lower limit. Hereinafter, a "second contrast (BL_c, refer to FIG. 21)" denotes a value related to the ratio between the maximum transmittance (BL_max) and the minimum transmittance (BL_min) of the dimming panel 80. The second contrast represents the "contrast of the dimming panel 80", and is given as, for example, BL_c=BL_max/BL_min. Assuming that BL_c=500, the minimum transmittance (BL_min) of the dimming panel 80 is 1/500 of the maximum transmittance (BL_max) thereof.

Figure 19:
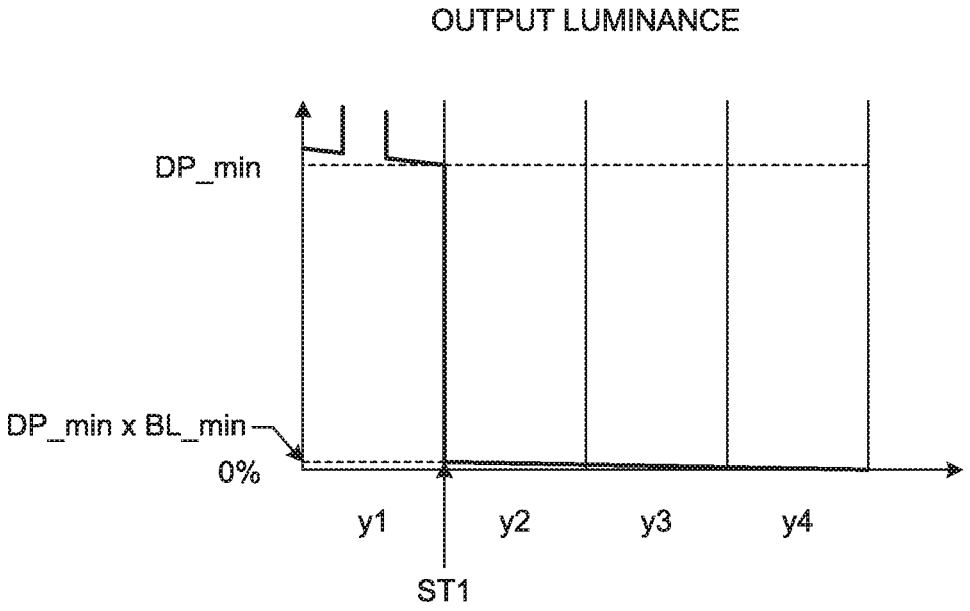
FIG. 19 is a magnified schematic diagram of the output luminance obtained when the dimming panel having the transmittance illustrated in FIG. 18 is interposed between the light source device having the light source luminance distribution illustrated in FIG. 13 and the image display panel having the transmittance illustrated in FIG. 14.

FIG. 19 is a magnified schematic diagram of the output luminance obtained when the dimming panel 80 having the transmittance illustrated in FIG. 18 is interposed between the light source device having the light source luminance distribution illustrated in FIG. 13 and the image display panel 30 having the transmittance illustrated in FIG. 14. To obtain the output luminance illustrated in FIG. 15, the display segment regions PA at (y2), (y3), and (y4) do not need the light. Therefore, as illustrated in FIG. 18, the dimming panel 80 is operated such that the dimming areas LD at (y2), (y3), and (y4) have the minimum transmittance (BL_min), whereby the output luminance can be further reduced at (y2), (y3), and (y4). Specifically, as illustrated in FIG. 19, the output luminance of the display segment regions PA at (y2), (y3), and (y4) can be reduced to output luminance corresponding to the product of the minimum transmittance (DP_min) of the image display panel 30 and the minimum transmittance (BL_min) of the dimming panel 80. For example, assume that the quantity of the light can be reduced to a lowered rate of approximately 0.2[%] by setting the transmittance of the dimming panel 80 having the second contrast of 500 to the minimum transmittance (BL_min). In this case, the output luminance of the display segment regions PA at (y2), (y3), and (y4) can be reduced to 0.0002 [%] by combining the image display panel 30 having the first contrast of 1000 with the dimming panel 80 having the second contrast of 500. In this manner, using the dimming panel 80 can restrain the black floating U such as that illustrated in FIG. 16.

Since the output luminance of 100[%] is needed at (y1), the transmittance of the dimming area LD at (y1) is set to the maximum transmittance (BL_max). As a result, unlike in the display segment regions PA at (y2), (y3), and (y4), the black floating U is not restrained by the dimming panel 80 in regions of the display segment regions PA at (y1) other than the regions having the output luminance of 100[%], as illustrated in FIG. 19. As a result, an abrupt change line ST1 of the output luminance is generated at the boundary between the display segment regions PA at (y1) and the display segment regions PA at (y2).

Figure 20:
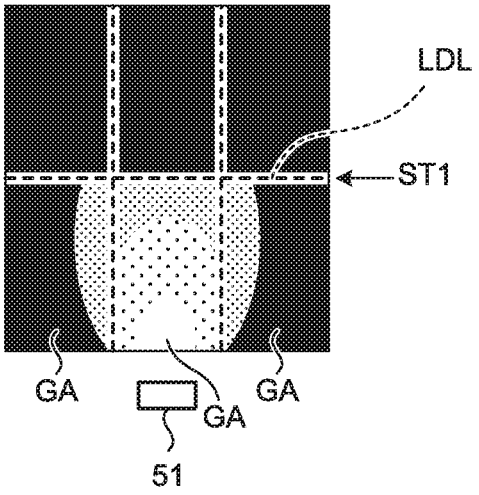
FIG. 20 is a schematic diagram illustrating an example of an abrupt change line of the output luminance.

FIG. 20 is a schematic diagram illustrating an example of the abrupt change line ST1 of the output luminance. When the abrupt change line ST1 of the output luminance is generated, the boundary line LDL between the adjacent dimming areas LD serves as the boundary between the area in which the black floating U is restrained by the dimming panel 80 and the area in which the black floating U is not restrained, and the luminance difference between those areas is sometimes visually recognized as a belt-like halo along the X-direction, as illustrated in FIG. 20.

Accordingly, the signal processor 10 of the first embodiment serves as a controller that increases, when adjacent two of the dimming areas LD differ in light transmittance from each other, the output gradation values of pixels that are in the vicinity of the boundary (such as within an area containing a predetermined number of pixels (x_pix) extending from the boundary) between the two adjacent dimming areas LD and located in one of the two dimming areas having lower light transmittance. This control can restrain the generation of the abrupt change line ST1 of the output luminance.

Figure 21:
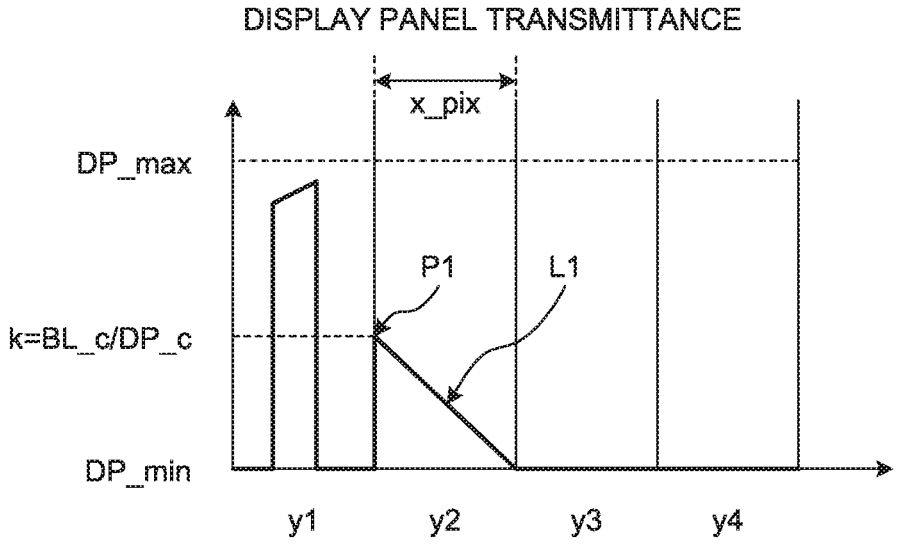
FIG. 21 is a diagram illustrating an example of the transmittance of the image display panel that outputs the image under the condition that the light source luminance distribution illustrated in FIG. 13 and the transmittance of the dimming panel illustrated in FIG. 18 are obtained in the first embodiment.

FIG. 21 is a diagram illustrating an example of image data output to the image display panel 30 under the conditions of the light source luminance distribution illustrated in FIG. 13 and the transmittance of the dimming panel 80 illustrated in FIG. 18 in the first embodiment. As illustrated, for example, in FIG. 21, the signal processor 10 assumes one end of the display segment regions PA at (y2) to be a pixel 48 located in a position (position P1) closest to the boundary between the display segment regions PA at (y1) and the display segment regions PA at (y2), and sets, as target pixels, the pixels 48 located within the area containing the predetermined number of pixels (x_pix) extending from the one end side toward the other end side. The predetermined number of pixels (x_pix) is equal to or smaller than the number of pixels in the Y-direction included in a single display segment region PA. In the example illustrated in FIG. 21, the width in the Y-direction of each of the display segment regions PA at (y2), that is, the number of pixels in the Y-direction included in one of the display segment regions PA is equal to the predetermined number of pixels (x_pix). However, this is a mere example. The predetermined number of pixels (x_pix) is not limited to this example.

The signal processor 10 sets the output gradation values of the target pixels closer to the boundary between the two of the dimming areas LD to higher values. Specifically, the signal processor 10 (refer to FIG. 23) sets the gradation values of the pixel 48 located in the position P1 among the target pixels to values corresponding a ratio (k) between the first contrast and the second contrast. Specifically, for example, k=BL_c/DP_c. For example, when BL_c=500, and DP_c=1000, k=0.5 (=50[%]). In this case, the signal processor 10 increases the gradation values of the pixel 48 in the position P1 to gradation values that reduce the transmittance of the image display panel 30 to 50[%]. As a specific example, since the display output of the display segment regions PA at (y2) is black for all the pixels 48 therein, the gradation values before being increased are (R,G,B)=(0,0,0). The signal processor 10 increases the gradation values of the pixel 48 in the position P1 to gradation values corresponding to a gray of 50[%]. When the gradation values are 8-bit values, the gradation values of the gray of 50[%] are (R,G,B)=(127,127,127). The signal processor 10 corrects the gradation values of each of the target pixels other than the pixel 48 in the position P1 to values higher than (R,G,B)=(0,0,0). Specifically, the signal processor 10 determines the degree of correction such that the corrected gradation values of the target pixels gradually decrease from the one end side toward the other end side. In FIG. 21, as indicated by a straight line L1, the corrected gradation values of the target pixels gradually linearly decrease from the one end side toward the other end side. This is, however, a mere example of the relation between the position in the Y-direction of each of the target pixels and the degree of correction of the gradation values. The relation between the position in the Y-direction of each of the target pixels and the degree of correction of the gradation values is not limited to this example, and may be represented by, for example, a quadratic or higher-order curve.

Figure 22:
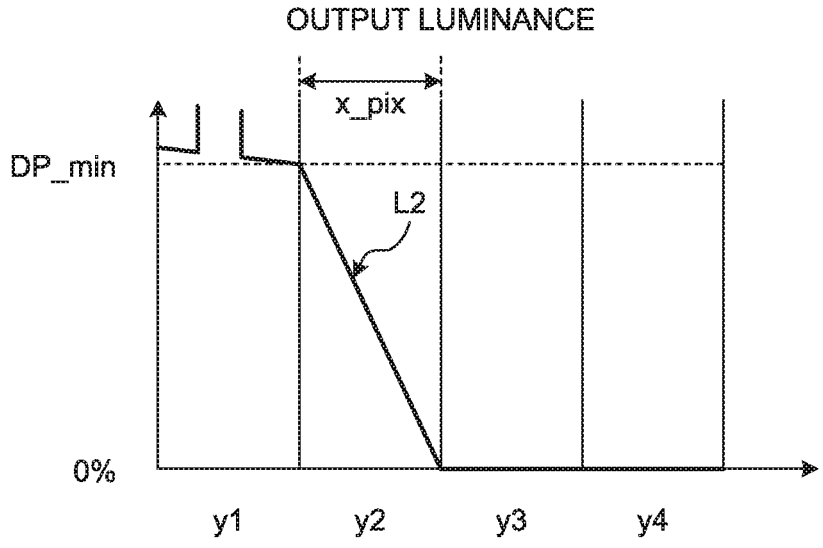
FIG. 22 is a magnified schematic diagram of the output luminance obtained when the dimming panel having the transmittance illustrated in FIG. 18 is interposed between the light source device having the light source luminance distribution illustrated in FIG. 13 and the image display panel having the transmittance illustrated in FIG. 21.

FIG. 22 is a magnified schematic diagram of the output luminance obtained when the dimming panel 80 having the transmittance illustrated in FIG. 18 is interposed between the light source device having the light source luminance distribution illustrated in FIG. 13 and the image display panel 30 having the transmittance illustrated in FIG. 21. Since the signal processor 10 increases the gradation values of the target pixels, the output luminance in the display segment regions PA at (y2) gradually decreases from the one end side toward the other end side, as illustrated in FIG. 22. This can restrain the generation of the abrupt change line ST1 of the output luminance described with reference to FIGS. 19 and 20. Consequently, the luminance difference caused by the difference in transmittance between the two adjacent dimming areas LD can be made less visible. Accordingly, the occurrence of the belt-like halo can be restrained, and improvement can be made in display quality and contrast perception resulting from the restraint of the black floating U.

Although FIG. 22 illustrates the gradual reduction of the output luminance in the display segment regions PA at (y2) with a straight line L2, the straight line L2 merely illustrates the gradual reduction of the output luminance corresponding to the straight line L1 illustrated in FIG. 21. The gradual reduction of the output luminance is not limited to the straight line L2. The gradual reduction pattern of the output luminance resulting from the correction of the gradation values of the target pixels is a pattern corresponding to the relation between the position in the Y-direction of each of the target pixels and the degree of correction of the gradation values.

Figure 23:
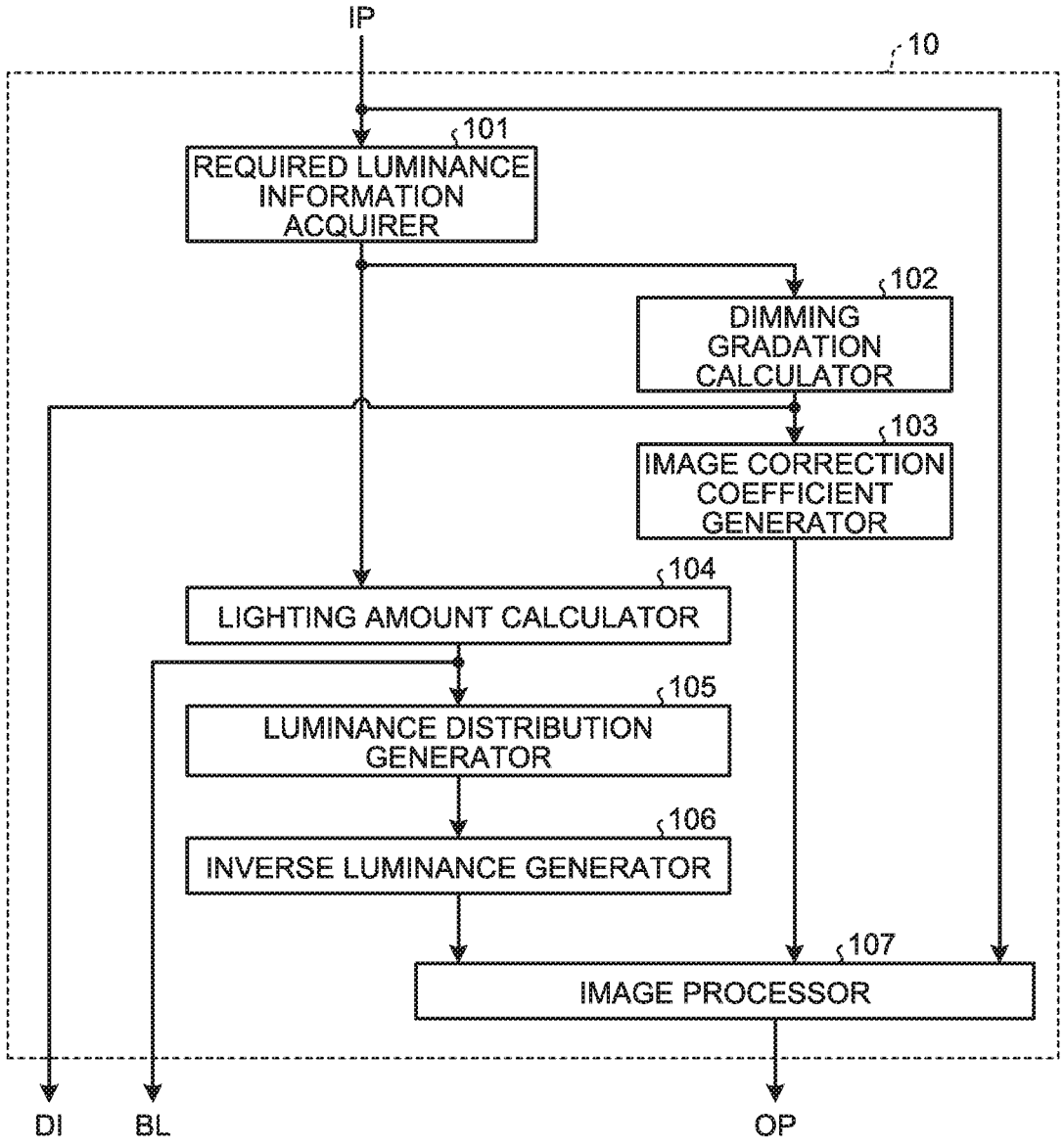
FIG. 23 is a block diagram illustrating an exemplary functional configuration of a signal processor.

FIG. 23 is a block diagram illustrating an exemplary functional configuration of the signal processor 10. The signal processor 10 of the first embodiment is an integrated circuit, such as a field-programmable gate array (FPGA) and so on. As illustrated, for example, in FIG. 23, the signal processor 10 includes, for example, a required luminance information acquirer 101, a dimming gradation calculator 102, an image correction coefficient generator 103, the lighting amount calculator 104, a luminance distribution generator 105, an inverse luminance generator 106, and an image processor 107.

The required luminance information acquirer 101 acquires the luminance of the light source 51 required for each of the display segment regions PA for performing the display output corresponding to the input signals IP. Specifically, the required luminance information acquirer 101 identifies the gradation value of the sub-pixel 49 set to have the maximum gradation value in each of the display segment regions PA. More specifically, the required luminance information acquirer 101 segments the gradation values of the respective sub-pixels 49 represented by the input signals IP for each of the display segment regions PA. The required luminance information acquirer 101 identifies the gradation value of the sub-pixel 49 set to have the maximum gradation value from among gradation values of the sub-pixels 49 included in a single display segment region PA. The required luminance information acquirer 101 identifies the luminance of the light source 51 required for obtaining output luminance corresponding to the gradation value of the sub-pixel 49 set to have the maximum gradation value in each of the display segment regions PA. For example, when the gradation value of the sub-pixel 49 is an 8-bit value (0 to 255), the luminance of the light source 51 required for obtaining the output luminance corresponding to a gradation value of 255 is 100[%]. The luminance of the light source 51 required for obtaining the output luminance corresponding to a gradation value of 0 is 0[%]. The required luminance information acquirer 101 performs the processing of identifying the luminance of the light source 51 as described above, for each of the display segment regions PA. The required luminance information acquirer 101 acquires information indicating the identified luminance of the light source 51 of each of the display segment regions PA as required luminance information. The required luminance is calculated taking account of attenuation in intensity of the light with the distance from the light source 51.

The dimming gradation calculator 102 calculates the gradation value of each of the dimming areas LD. Specifically, the dimming gradation calculator 102 segments the display segment regions PA for each of the coordinates in the Y-direction (such as (y1), (y2), (y3), and (y4)). The dimming gradation calculator 102 calculates the transmittance of the dimming area LD at (y1) with reference to the required luminance information acquired by the required luminance information acquirer 101. For example, if the required luminance of all the display segment regions PA having the coordinate at (y1) in the Y-direction is 0[%], the dimming gradation calculator 102 of the first embodiment calculates the transmittance of the dimming area LD at (y1) to be the minimum transmittance (BL_min), or if not, the dimming gradation calculator 102 of the first embodiment calculates the transmittance of the dimming area LD at (y1) to be the maximum transmittance (BL_max). The dimming gradation calculator 102 calculates the gradation values such that a gradation value (such as 0) of the dimming area LD having the minimum transmittance (BL_min) is distinguishable from a gradation value (such as 1) of the dimming area LD having the maximum transmittance (BL_max). The dimming gradation calculator 102 also calculates the transmittance and the gradation values of the dimming areas LD at (y2), (y3), and (y4) in the same manner as in the case of the dimming area LD at (y1). The dimming gradation calculator 102 outputs signals including the information indicating the calculated gradation values of the dimming areas LD as the local dimming signals DI.

In the first embodiment, the dimming area LD is controlled to have the minimum transmittance (BL_min) according to the gradation value (such as 0) of the dimming area LD having the minimum transmittance (BL_min). The dimming area LD is controlled to have the maximum transmittance (BL_max) in accordance with the gradation value (such as 1) of the dimming area LD having the maximum transmittance (BL_max).

The image correction coefficient generator 103 calculates an image correction coefficient (kpix(v)) used for correction to increase the output gradation values of the target pixels. Specifically, if, for example, gradation values of adjacent two of the dimming areas LD among the gradation values of the dimming areas LD calculated by the dimming gradation calculator 102 differ from each other, the image correction coefficient generator 103 sets the target pixels in one of the dimming areas LD for which gradation values corresponding to lower transmittance have been calculated. The image correction coefficient generator 103 uses the scheme described with reference to FIG. 21 to calculate correction values for correcting the output gradation values of the respective target pixels. The image correction coefficient generator 103 calculates the correction values for pixels other than the target pixels to be zero. The image correction coefficient generator 103 calculates the image correction coefficient (kpix(v)) in the form of a function (such as a linear function) associating the calculated correction value with arrangement of the pixels 48 aligning from one end side to the other end side (or from the other end side to the one end side) in the Y-direction. In the first embodiment, the image correction coefficient (kpix(v)) is sequentially read to obtain the correction values for the pixels 48 aligning from the one end side to the other end side in the Y-direction. As described above, the image correction coefficient (kpix(v)) includes the information associating the correction values with the positions of the target pixels for which the correction values for increasing the gradation values are set. Since the image correction coefficient (kpix(v)) gives a correction value of zero to the pixels 48 that are not the target pixels, the target pixels are limited to the pixels 48 to be increased in gradation values by the correction.

The lighting amount calculator 104 calculates the lighting amount of each of the light sources 51 based on the required luminance information. Specifically, as described with reference to FIGS. 13 and 14, the lighting amount calculator 104 calculates the lighting amount of each of the light sources 51 such that the required luminance on the other end side of each of the display segment regions PA is sufficiently obtained. Information indicating a relation between the lighting amounts of the light sources 51 and the luminance on the other end side of the display segment regions PA may be included, for example, in the reference data, or in data included in the lighting amount calculator 104 that is prepared separately from the reference data. The lighting amount calculator 104 outputs a signal including the information indicating the calculated lighting amount of each of the light sources 51 as the light source drive signal BL.

The luminance distribution generator 105 generates information indicating the luminance distribution obtained by the lighting amounts of the light sources 51 calculated by the lighting amount calculator 104. Specifically, the luminance distribution generator 105 generates the information indicating the luminance distribution in the Y-direction in the positions of the pixels 48 arranged in the X-direction based on the lighting amount of each of the light sources 51 calculated by the lighting amount calculator 104. More specifically, the luminance distribution generator 105 has data indicating, for example, a relation between the lighting amount of each of the light sources 51 and the luminance distribution that are measured in advance taking into account the influence of the light from the light sources 51. With reference to the data, the luminance distribution generator 105 generates the information indicating the luminance distribution in the Y-direction (v) in the positions (h) of the pixels 48 arranged in the X-direction. In other words, the luminance of the light from the light source device 50 in the position of the pixel 48 at (h,v) can be identified from the information indicating the luminance distribution generated by the luminance distribution generator 105.

Based on the luminance distribution generated by the luminance distribution generator 105, the inverse luminance generator 106 generates the inverse of the luminance (inverse luminance gainpix(h,v)) corresponding to the position of the pixel 48 at (h,v). Specifically, the inverse luminance generator 106 performs, for example, processing of converting the luminance distribution represented in percentage [%] generated by the luminance distribution generator 105 into that represented in decimal number (processing of division by 100) and generates the inverse of the value represented in decimal number as the inverse luminance gainpix(h,v) corresponding to the position of the pixel 48 at (h,v). For example, in the case of the pixel 48 associated with luminance of 120[%] in the information indicating the luminance distribution, the inverse luminance gainpix(h,v) is approximately 0.83. In the case of the pixel 48 associated with luminance of 60[%] in the information indicating the luminance distribution, the inverse luminance gainpix(h,v) is approximately 1.67.

The image processor 107 calculates the output gradation values of the pixels 48 serving as the output image signals OP based on the gradation values of the pixel 48 included in the input signals IP, the inverse luminance gainpix(h,v) generated by the inverse luminance generator 106, and the image correction coefficient (kpix(v)) calculated by the image correction coefficient generator 103. Specifically, the image processor 107 multiplies the gradation values of the pixels 48 included in the input signals IP by the gain. More specifically, the image processor 107 multiplies the gradation value of each of R, G, and B included in the gradation values of the pixel 48 at (h,v) by the inverse luminance gainpix(h,v). This multiplication applies the gain to the gradation value of each of R, G, and B. However, the gradation values of black (R,G,B)=(0,0,0) obtain no gain. The image processor 107 may omit the application of the gain to the gradation values of black (R,G,B)=(0,0,0). The image processor 107 adds the image correction coefficient (kpix(v)) to the gradation values of black among the gradation values of the pixels 48 included in the input signals IP. More specifically, the image processor 107 adds the image correction coefficient (kpix(v)) to the gradation value of each of R, G, and B included in the gradation values of the pixel 48 at (v) in which (R,G,B)=(0,0,0). This calculation can increase the gradation values of the target pixel among the pixels 48 at (v) in which (R,G,B)=(0,0,0). The image processor 107 outputs the output image signals OP.

Figure 24:
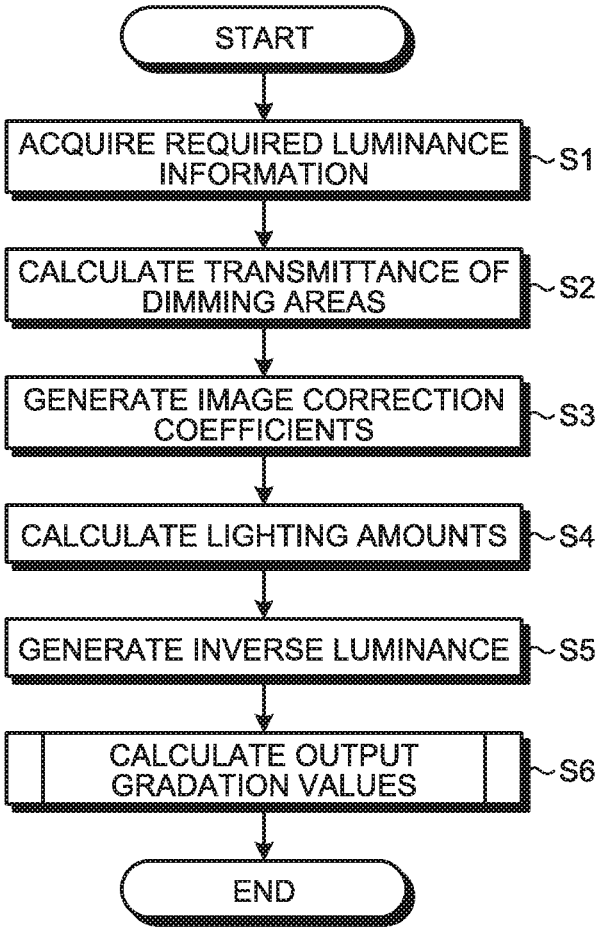
FIG. 24 is a flowchart of processing by the signal processor.

FIG. 24 is a flowchart of processing by the signal processor 10. The signal processor 10 performs the acquisition of the required luminance information (Step S1), the calculation of the transmittance of the dimming areas LD (Step S2), the generation of the image correction coefficient (Step S3), the calculation of the lighting amounts (Step S4), the generation of the inverse of the luminance (Step S5), and the calculation of the output gradation values (Step S6). Of the processes from Step S1 to Step S6, the processes from Step S2 to Step S3 and the processes from Step S4 to Step S5 may be performed in parallel after the process at Step S1. The process at Step S6 is performed after the processes at Step S3 and Step S5.

Figure 25:
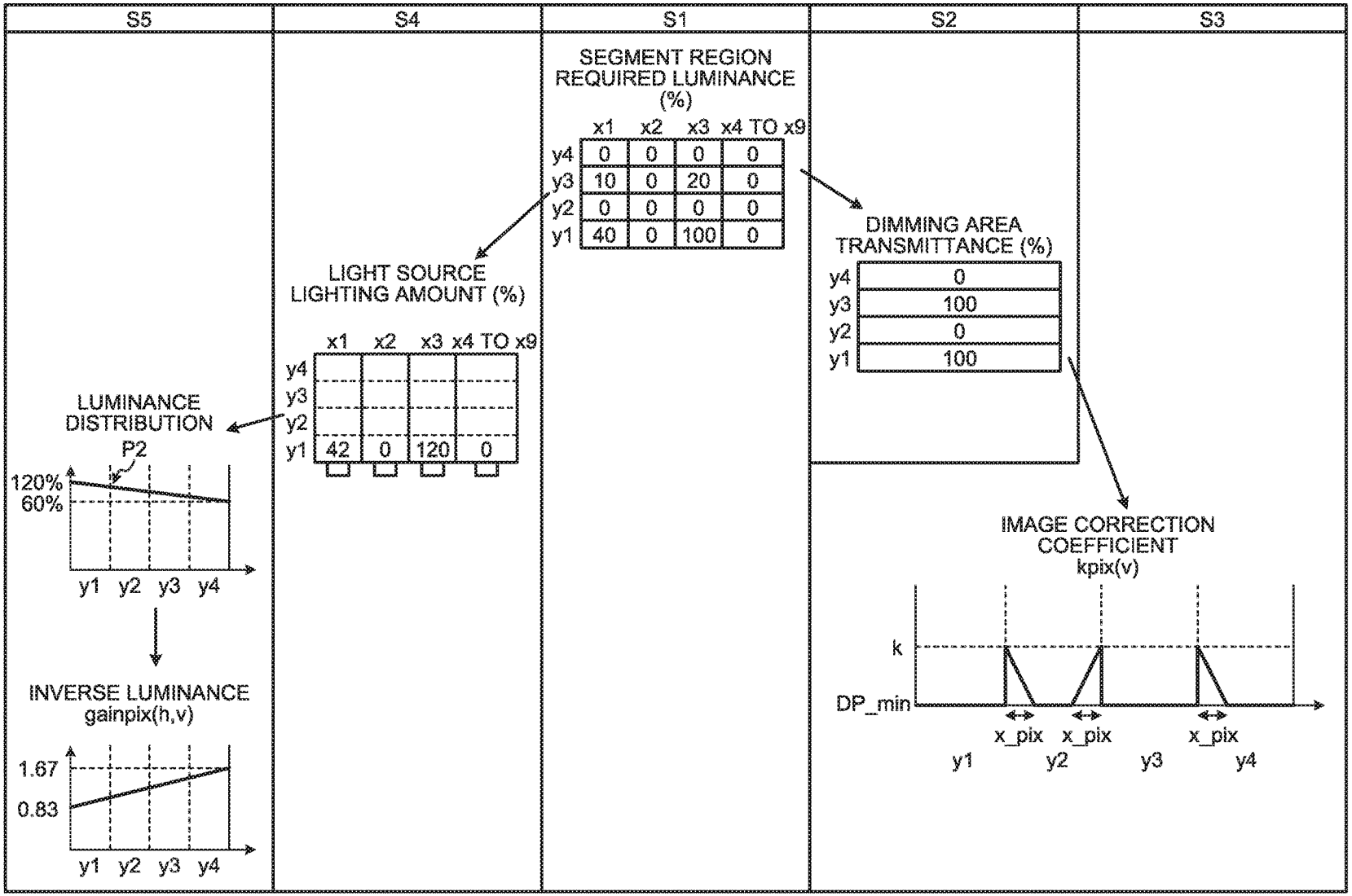
FIG. 25 is a diagram schematically illustrating an example of processing details of Step S1 to Step S5 in the flowchart illustrated in FIG. 24.

FIG. 25 is a diagram schematically illustrating an example of processing details of Step S1 to Step S5 in the flowchart illustrated in FIG. 24. During the acquisition of the required luminance information (Step S1), the required luminance information acquirer 101 acquires the luminance of each of the light sources 51 required for the display segment regions PA. FIG. 25 illustrates a case where, at Step S1, the required luminance levels of the display segment regions PA at (x1,y1), (x1,y3), (x3,y1), and (x3,y3) are 40 [%], 10 [%], 100 [%], and 20[%], respectively, and the required luminance levels of the display segment regions PA of the other positions are 0[%].

During the calculation of the transmittance of the dimming areas LD (Step S2), the dimming gradation calculator 102 calculates the transmittance of the dimming areas LD and the gradation values corresponding to the transmittance. FIG. 25 illustrates a case where, at Step S2, the transmittance of the dimming areas LD at (y1) and (y3) is the maximum transmittance (BL_max) (expressed as 100[%] in FIG. 25), and the transmittance of the dimming areas LD at (y2) and (y4) is the minimum transmittance (BL_min) (expressed as 0[%] in FIG. 25).

During the generation of the image correction coefficient (Step S3), the image correction coefficient generator 103 calculates the image correction coefficient (kpix(v)). FIG. 25 illustrates an example in which, at Step S3, the target pixels are set in the display segment regions PA at (y2) and (y4), and the correction values for increasing the gradation values are calculated for the case where the gradation values of the target pixels are (R,G,B)=(0,0,0). More specifically, in FIG. 25, assume that, among the pixels 48 included in the display segment regions PA at (y2), a pixel 48 located in a position closest to the boundary between the display segment regions PA at (y1) and the display segment regions PA at (y2) serves as one end, and a pixel 48 located in a position closest to the boundary between the display segment regions PA at (y2) and the display segment regions PA at (y3) serves as the other end. In this case, the pixels 48 located within the area containing the predetermined number of pixels (x_pix) extending from the one end side toward the other end side are set as the target pixels. In addition, the pixels 48 located within the area containing the predetermined number of pixels (x_pix) extending from the other end side toward the one end side are set as the target pixels. In this manner, the predetermined number of pixels (x_pix) may be determined in consideration of the case where the pixels 48 located within the areas containing the predetermined number of pixels (x_pix) extending from the one end side and the other end side in one of the display segment regions PA are set as the target pixels. For example, the predetermined number of pixels (x_pix) may be equal to or smaller than half the number of pixels in the Y-direction included in one of the display segment regions PA. In FIG. 25, assuming that, among the pixels 48 included in the display segment regions PA at (y4), a pixel 48 located in a position closest to the boundary between the display segment regions PA at (y3) and the display segment regions PA at (y4) serves as one end, the pixels 48 located within the area containing the predetermined number of pixels (x_pix) extending from the one end side toward the other end side are set as the target pixels.

During the calculation of the lighting amounts (Step S4), the lighting amount calculator 104 calculates the lighting amounts of the respective light sources 51. FIG. 25 illustrates a case where, at Step S4, the lighting amounts are calculated such that the light sources 51 at (x1) and (x3) are lit up at lighting amounts capable of obtaining luminance of 42[%] and 120[%], respectively, on one end side of the display segment regions PA at (y1).

During the generation of the inverse of the luminance (Step S5), the luminance distribution generator 105 generates the information indicating the luminance distribution obtained by the lighting amounts of the light sources 51 calculated by the lighting amount calculator 104. Then, the inverse luminance generator 106 generates the inverse luminance gainpix(h,v) corresponding to the position of the pixel 48 at (h,v) based on the luminance distribution generated by the luminance distribution generator 105. FIG. 25 illustrates the luminance distribution and the inverse luminance gainpix(h,v) that are generated at Step S5 corresponding to the light source 51 at (x3).

Figure 26:
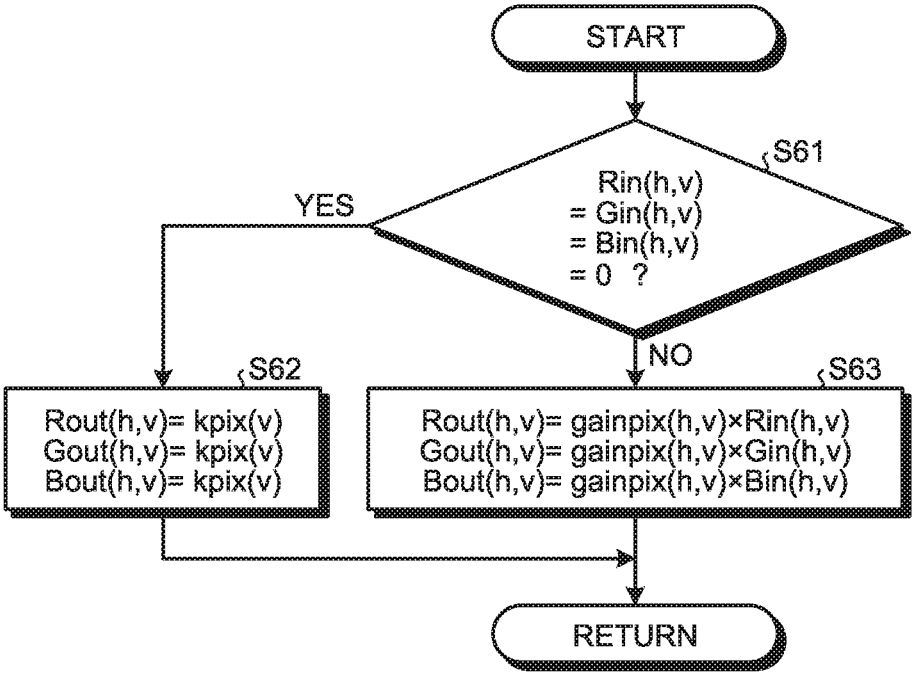
FIG. 26 is a flowchart of calculation processing of output gradation values in FIG. 24.

FIG. 26 is a flowchart of the calculation processing of the output gradation values in FIG. 24. During the calculation of the output gradation values (Step S6), the image processor 107 calculates the output gradation values of the pixels 48 serving as the output image signals OP. Specifically, the image processor 107 determines whether the gradation values of one of the pixels 48 included in the input signals IP are (R,G,B)=(0,0,0) (Step S61). More specifically, as illustrated, for example, in Step S61, the image processor 107 checks whether the gradation value is zero for each of the sub-pixels 49 included in the one of the pixels 48. In other words, the image processor 107 individually checks whether a gradation value (Rin(h,v)) of the first sub-pixel 49R, a gradation value (Gin(h,v)) of the second sub-pixel 49G, and a gradation value (Bin(h,v)) of the third sub-pixel 49B included in the input signals IP are zero.

If the gradation values of one of the target pixels included in the input signals IP are (R,G,B)=(0,0,0) (Yes at Steps S61), the image processor 107 adds the image correction coefficient (kpix (v)) to the gradation value of each of the sub-pixels 49 included in one of the pixels 48 determined to be the target pixels (Step S62). Specifically, the image processor 107 adds the image correction coefficient (kpix (v)) to each of the gradation value (Rin(h,v)) of the first sub-pixel 49R, the gradation value (Gin(h,v)) of the second sub-pixel 49G, and the gradation value (Bin(h,v)) of the third sub-pixel 49B included in the input signals IP. Thus, the image processor 107 calculates a gradation value (Rout (h,v)) of the first sub-pixel 49R, a gradation value (Gout(h, v)) of the second sub-pixel 49G, and a gradation value (Bout(h,v)) of the third sub-pixel 49B that serve as the output image signals OP.

If the gradation values of the one of the target pixels 48 included in the input signals IP are not (R,G,B)=(0,0,0) (No at Steps S61), the image processor 107 multiplies the gradation value of each of the sub-pixels 49 included in the one of the pixels 48 having been subjected to the determination by the inverse luminance gainpix(h,v) (Step S63). Specifically, the image processor 107 multiplies each of the gradation value (Rin(h,v)) of the first sub-pixel 49R, the gradation value (Gin(h,v)) of the second sub-pixel 49G, and the gradation value (Bin(h,v)) of the third sub-pixel 49B included in the input signals IP by the inverse luminance gainpix(h,v). Thus, the image processor 107 calculates the gradation value (Rout(h,v)) of the first sub-pixel 49R, the gradation value (Gout(h,v)) of the second sub-pixel 49G, and the gradation value (Bout(h,v)) of the third sub-pixel 49B that serve as the output image signals OP.

As described above, according to the first embodiment, when adjacent two of the dimming areas LD differ in light transmittance from each other, the pixels 48 located close to the boundary between the two dimming areas LD are selected as the target pixels from among pixels located in one of the dimming areas LD having lower light transmittance, and the output gradation values of the target pixels are increased. As a result, the occurrence of the belt-like halo can be restrained, and the improvement can be made in display quality and contrast perception resulting from the restraint of the black floating U.

The output gradation values of the target pixels closer to the boundary between the two dimming areas LD are set higher. This setting facilitates the gradual reduction of the output luminance of the display device 1 with the distance from the vicinity of the boundary between the two dimming areas LD. Accordingly, the occurrence of the belt-like halo can be restrained in a more reliable manner.

Modification

The following describes a modification of the first embodiment with reference to FIGS. 27 to 30. In the description of the modification, the same reference numerals will be assigned to the same components as those of the first embodiment described with reference to FIGS. 1 to 26, and description thereof will not be made in some cases.

Figure 27:
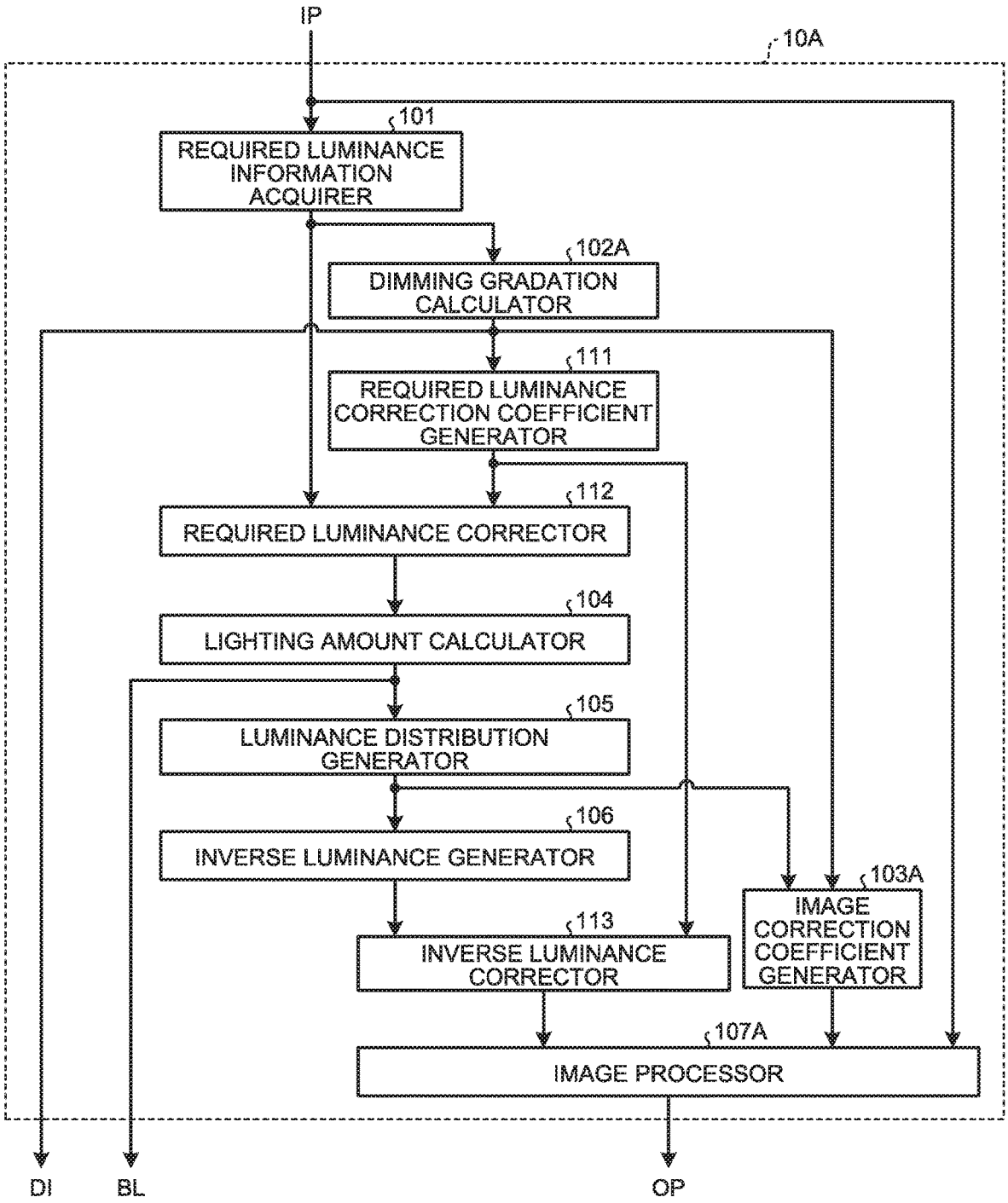
FIG. 27 is a block diagram illustrating another exemplary functional configuration of a signal processor in a modification.

FIG. 27 is a block diagram illustrating another exemplary functional configuration of a signal processor 10A in the modification. The display device according to the modification includes the signal processor 10A as a component instead of the signal processor 10 of the first embodiment. The signal processor 10A of the modification includes a required luminance correction coefficient generator 111, a required luminance corrector 112, and an inverse luminance corrector 113, in addition to the components of the signal processor 10 of the first embodiment. The signal processor 10A of the modification also includes a dimming gradation calculator 102A, an image correction coefficient generator 103A, and an image processor 107A, instead of the dimming gradation calculator 102, the image correction coefficient generator 103, and the image processor 107 of the first embodiment.

The dimming gradation calculator 102A of the modification calculates the transmittance of the dimming area LD at (y1) with reference to the required luminance information acquired by the required luminance information acquirer 101. For example, if the required luminance of all the display segment regions PA having the coordinate at (y1) in the Y-direction is 0[%], the dimming gradation calculator 102A calculates the transmittance of the dimming area LD at (y1) to be the minimum transmittance (BL_min). If the maximum required luminance of the required luminance of the display segment regions PA having the coordinate at (y1) in the Y-direction exceeds 0[%] and is equal to or less than 25[%], the dimming gradation calculator 102A sets the transmittance of the dimming area LD at (y1) to be first intermediate transmittance. The dimming gradation calculator 102A calculates the first intermediate transmittance to be, for example, 25[%]. If the maximum required luminance of the required luminance of the display segment regions PA at (y1) exceeds 25[%] and is equal to or less than 50[%], the dimming gradation calculator 102A sets the transmittance of the dimming area LD at (y1) to be second intermediate transmittance. The dimming gradation calculator 102A calculates the second intermediate transmittance to be, for example, 50[%]. If neither of the above described conditions is met, the dimming gradation calculator 102A calculates the transmittance of the dimming area LD at (y1) to be the maximum transmittance (BL_max). The dimming gradation calculator 102A calculates the gradation values such that the gradation value (such as 0) of the dimming area LD having the minimum transmittance (BL_min), the gradation value (such as 1) of the dimming area LD having the first intermediate transmittance, the gradation value (such as 2) of the dimming area LD having the second intermediate transmittance, and the gradation value (such as 3) of the dimming area LD having the maximum transmittance (BL_max) are distinguishable from one another. The dimming gradation calculator 102A also calculates the transmittance and the gradation values of the dimming areas LD at (y2), (y3), and (y4) in the same manner as in the case of the dimming area LD at (y1). The dimming gradation calculator 102A outputs signals including the information indicating the calculated gradation values of the dimming areas LD as the local dimming signals DI in the modification.

In the modification, the dimming area LD is controlled to have the minimum transmittance (BL_min) according to the gradation value (such as 0) of the dimming area LD having the minimum transmittance (BL_min). The dimming area LD is controlled to have the transmittance of 25[%] in accordance with the gradation value (such as 1) of the dimming area LD having the first intermediate transmittance. The dimming area LD is controlled to have the transmittance of 50[%] in accordance with the gradation value (such as 2) of the dimming area LD having the second intermediate transmittance. The dimming area LD is controlled to have the maximum transmittance (BL_max) in accordance with the gradation value (such as 3) of the dimming area LD having the maximum transmittance (BL_max). In this manner, the dimming areas LD of the modification are capable of changing the light transmittance to the minimum transmittance (BL_min), to the maximum transmittance (BL_max), or to any of one or more degrees of intermediate transmittance serving as transmittance between the minimum transmittance (BL_min) and the maximum transmittance (BL_max). The intermediate transmittance may be of one degree or three or more degrees, or may be set to any transmittance between 0% and 100%.

The required luminance correction coefficient generator 111 generates a required luminance correction coefficient based on the gradation values calculated by the dimming gradation calculator 102A. The required luminance correction coefficient is a coefficient for correcting the required luminance indicated by the required luminance information acquired by the required luminance information acquirer 101. Specifically, if the dimming value has, for example, four gradations, the required luminance correction coefficient generator 111 sets the required luminance correction coefficient of the dimming area LD having a gradation value of 0 or 3 to 1.0. In other words, the required luminance correction coefficient generator 111 sets the required luminance correction coefficient of the dimming area LD having the minimum transmittance (BL_min) or the maximum transmittance (BL_max) to 1.0. The required luminance correction coefficient generator 111 sets the required luminance correction coefficient of the dimming area LD having a gradation value of 1 to 4.0. In other words, the required luminance correction coefficient generator 111 sets the required luminance correction coefficient of the dimming area LD having the transmittance of 25[%] to 4.0. The required luminance correction coefficient generator 111 sets the required luminance correction coefficient of the dimming area LD having a gradation value of 2 to 2.0. In other words, the required luminance correction coefficient generator 111 sets the required luminance correction coefficient of the dimming area LD having the transmittance of 50[%] to 2.0.

The required luminance corrector 112 corrects the required luminance information acquired by the required luminance information acquirer 101 based on the required luminance correction coefficient generated by the required luminance correction coefficient generator 111. Specifically, the required luminance corrector 112 multiplies the required luminance of each of the display segment regions PA by the required luminance correction coefficient of the dimming area LD located at corresponding coordinates in the Y-direction. The lighting amount calculator 104 of the modification calculates the lighting amount of each of the light sources 51 based on the required luminance information corrected by the required luminance corrector 112.

If the light transmittance in one of the two adjacent dimming areas LD having lower light transmittance is the minimum transmittance (BL_min), the image correction coefficient generator 103A of the modification causes the output gradation values of the target pixels to be higher than those in the case where the lower light transmittance is not the minimum transmittance. Specifically, if the light transmittance in one of the two adjacent dimming areas LD having lower light transmittance is the minimum transmittance (BL_min), the image correction coefficient generator 103A performs the same processing as that performed by the image correction coefficient generator 103 described with reference to FIG. 21. Specifically, the image correction coefficient generator 103A sets the gradation values of the pixel 48 located in the position P1 among the target pixels to values corresponding the ratio (k) between the first contrast and the second contrast (for example, k=0.5 (=50 [%])).

If the light transmittance in one of the two adjacent dimming areas LD having lower light transmittance is not the minimum transmittance (BL_min), the image correction coefficient generator 103A calculates a correction value (ka) for the gradation values of the pixel 48 located in the position P1 based on Expression (1) below. In Expression (1), B(PY) denotes the luminance (in [%]) at the boundary between the two adjacent dimming areas LD provided by the light source 51; BL_high denotes the light transmittance (in [%]) in one of the two adjacent dimming areas LD having higher light transmittance; and BL_low denotes the light transmittance (in [%]) in one of the two adjacent dimming areas LD having lower light transmittance.

$$ka=(B(PY)/DP_con)\times(BP_con/DP_con)/(BL_high/BL_low) \quad (1)$$

For example, if B(PY)=120[%], DP_con=1000, BP_con=500, BL_high=100[%], and BL_low=25[%], then ka=0.24[%]. The values of and the relation between the various values in Expression (1) are such that ka is always lower than the ratio (k) between the first contrast and the second contrast.

In the same manner as the image correction coefficient generator 103, the image correction coefficient generator 103A determines the degree of correction on a pixel by pixel basis such that the corrected gradation values of each of the target pixels gradually decrease from the one end side toward the other end side (from the other end side toward the one end side if the position P1 lies on the other end side). The image correction coefficient generator 103A calculates the calculated correction value as the image correction coefficient (kpix(h,v)). In the modification, the luminance (in [%]) at the boundary between the two adjacent dimming areas LD that is provided by the light source 51 can change with the position in the X-direction, and thus the coordinate management of the image correction coefficient is performed in the X-direction. In other words, in the modification, the image correction coefficient specific to each of the pixels 48 is calculated with respect to not only the Y-direction but also the X-direction.

Based on the required luminance correction coefficient generated by the required luminance correction coefficient generator 111, the inverse luminance corrector 113 corrects the inverse luminance gainpix(h,v) generated by the inverse luminance generator 106. Specifically, the inverse luminance corrector 113 multiplies the inverse luminance gainpix(h,v) by the required luminance correction coefficient of the dimming area LD located at corresponding coordinates in the Y-direction. The inverse luminance corrector 113 outputs the corrected inverse luminance gainpix(h,v) as inverse luminance Egainpix(h,v).

The image processor 107A of the modification uses the inverse luminance Egainpix(h,v) corrected by the inverse luminance corrector 113, and multiplies the gradation values of the pixels 48 included in the input signals IP by the gain, and then adds the image correction coefficient (kpix(h,v)) to each of the results regardless of whether the gradation values of the pixels 48 included in the input signals IP are gradation values corresponding to black. The configuration of the image processor 107A of the modification is the same as that of the image processor 107 of the first embodiment except in the processing on the gradation values of the pixels 48 included in the input signals IP.

Figure 28:
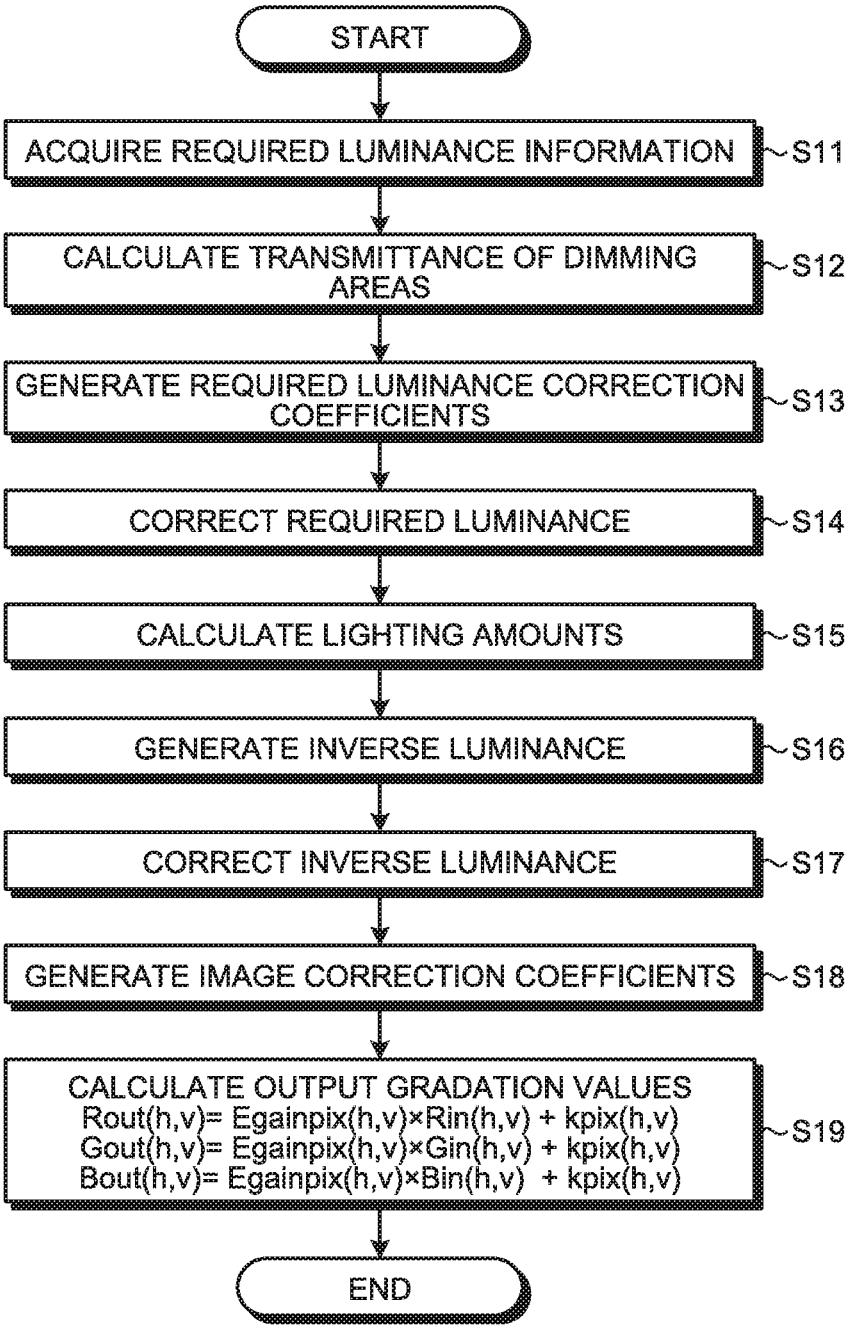
FIG. 28 is a flowchart of processing by the signal processor of the modification.

FIG. 28 is a flowchart of processing by the signal processor 10A of the modification. The signal processor 10A performs the acquisition of the required luminance information (Step S11), the calculation of the transmittance of the dimming areas LD (Step S12), the generation of the required luminance correction coefficients (Step S13), the correction of the required luminance (Step S14), the calculation of the lighting amounts (Step S15), the generation of the inverse of the luminance (Step S16), the correction of the inverse of the luminance (Step S17), the generation of the image correction coefficients (Step S18), and the calculation of the output gradation values (Step S19).

Figure 29:
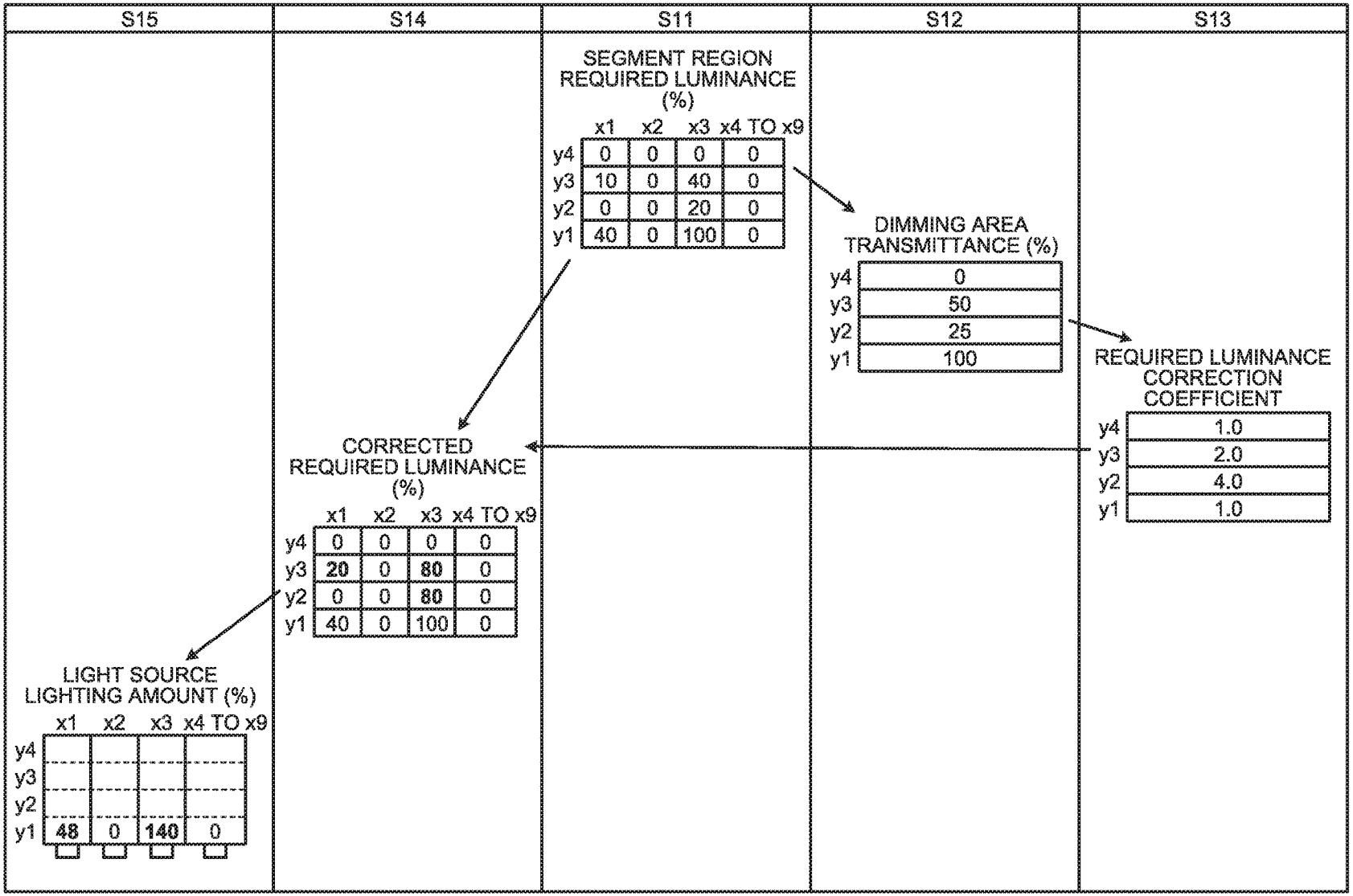
FIG. 29 is a diagram schematically illustrating an example of processing details performed at Step S11 to Step S15 in the flowchart illustrated in FIG. 28.

FIG. 29 is a diagram schematically illustrating an example of processing details performed at Step S11 to Step S15 in the flowchart illustrated in FIG. 28. During the acquisition of the required luminance information (Step S11), the required luminance information acquirer 101 acquires the luminance of the light source 51 required for each of the display segment regions PA. FIG. 29 illustrates a case where, at Step S11, the required luminance levels of the display segment regions PA at (x1,y1), (x1,y3), (x3,y1), (x3,y2), and (x3,y3) are 40[%], 10[%], 100[%], 20[%], and 40[%], respectively, and the required luminance of the display segment regions PA of the other positions is 0[%].

During the calculation of the transmittance of the dimming areas (Step S12), the dimming gradation calculator 102A calculates the transmittance of the dimming areas LD and the gradation values corresponding to the transmittance. FIG. 29 illustrates a case where, at Step S12, the transmittance of the dimming area LD at (y1) is the maximum transmittance (BL_max) (expressed as 100[%] in FIG. 29), the transmittance of the dimming area LD at (y2) is the first intermediate transmittance (25 [%]), the transmittance of the dimming area LD at (y3) is the second intermediate transmittance (50[%]), and the transmittance of the dimming area LD at (y4) is the minimum transmittance (BL_min) (expressed as 0[%] in FIG. 29).

During the generation of the required luminance correction coefficients (Step S13), the required luminance correction coefficient generator 111 generates the required luminance correction coefficients. FIG. 29 illustrates a case where, at Step S13, the required luminance correction coefficients of the dimming areas LD at (y1) and (y4) are 1.0, the required luminance correction coefficient of the dimming area LD at (y2) is 4.0, and the required luminance correction coefficient of the dimming area LD at (y3) is 2.0.

During the correction of the required luminance (Step S14), the required luminance corrector 112 corrects the required luminance information based on the required luminance correction coefficients. In FIG. 29, at Step S14, the required luminance (10[%] and 40[%]) of the display segment regions PA at (x1,y3) and (x3,y3) is multiplied by the required luminance correction coefficient (2.0) of the dimming area LD at (y3), and as a result, the required luminance levels of the display segment regions PA at (x1,y3) and (x3,y3) are corrected to 20 [%] and 80[%], respectively. In addition, the required luminance (20[%]) of the display segment region PA at (x3,y2) is multiplied by the required luminance correction coefficient (4.0) of the dimming area LD at (y2), and as a result, the required luminance level of the display segment region PA at (x3,y2) is corrected to 80[%].

During the calculation of the lighting amounts (Step S15), the lighting amount calculator 104 of the modification calculates the lighting amounts of the respective light sources 51. FIG. 29 illustrates a case where, at Step S15, the lighting amounts are calculated such that the light sources 51 at (x1) and (x3) are lit up at lighting amounts capable of obtaining luminance of 48 [%] and 140[%], respectively, on one end side of the display segment regions PA at (y1).

Figure 30:
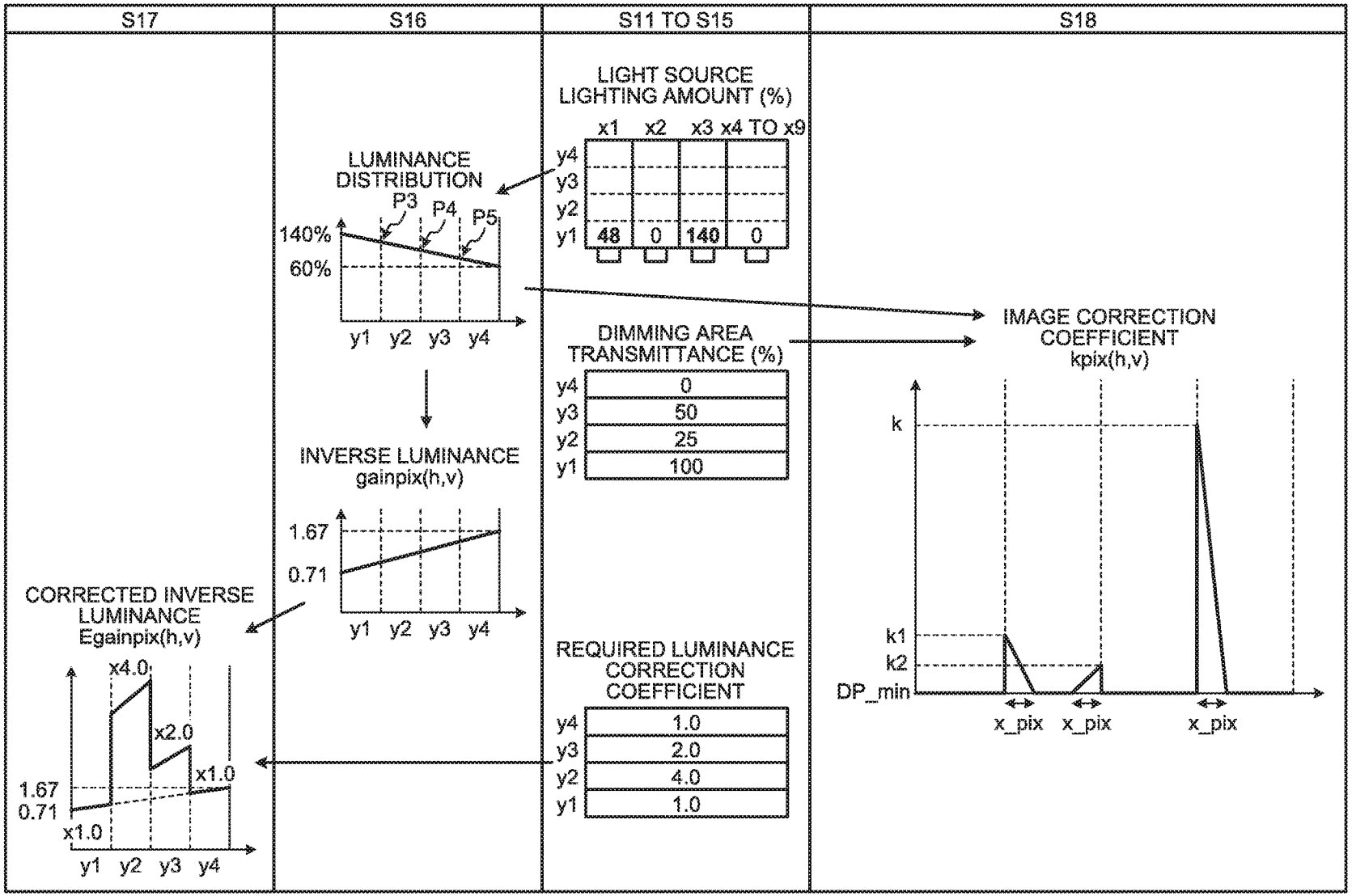
FIG. 30 is a diagram schematically illustrating an example of processing details performed at Step S16 to Step S18 in the flowchart illustrated in FIG. 28.

FIG. 30 is a diagram schematically illustrating an example of processing details performed at Step S16 to Step S18 in the flowchart illustrated in FIG. 28. During the generation of the inverse of the luminance (Step S16), the luminance distribution generator 105 generates the information indicating the luminance distribution based on the lighting amounts of the light sources 51 calculated by the lighting amount calculator 104. Then, the inverse luminance generator 106 generates the inverse luminance gainpix(h,v) corresponding to the position of the pixel 48 at (h,v) based on the luminance distribution generated by the luminance distribution generator 105. FIG. 30 illustrates the luminance distribution and the inverse luminance gainpix(h,v) that are generated at Step S16 corresponding to the light source 51 at (x3). The luminance distribution corresponding to the light source 51 at (x3) represents luminance P3 in the boundary position between the display segment regions PA at (y1) and the display segment regions PA at (y2) provided by the light source 51, luminance P4 in the boundary position between the display segment regions PA at (y2) and the display segment regions PA at (y3) provided by the light source 51, and luminance P5 in the boundary position between the display segment regions PA at (y3) and the display segment regions PA at (y4) provided by the light source 51. Of these values of the luminance, the luminance P5 corresponds to the required luminance (80[%]) of the display segment region PA at (x3,y3).

During the correction of the inverse of the luminance (Step S17), the inverse luminance corrector 113 corrects the inverse luminance gainpix(h,v). FIG. 30 illustrates, in Step S17, the correction of the inverse values of the luminance corresponding to the light source 51 at (x3). Specifically, the inverse luminance gainpix(h,v) at (y2) is multiplied by the required luminance correction coefficient (4.0) of the dimming area LD at (y2), and the inverse luminance gainpix(h,v) at (y3) is multiplied by the required luminance correction coefficient (2.0) of the dimming area LD at (y3). The inverse luminance corrector 113 outputs the corrected inverse luminance gainpix(h,v) as the inverse luminance Egainpix(h,v).

During the generation of the image correction coefficients (Step S18), the image correction coefficient generator 103A calculates the image correction coefficients (kpix(h,v)). FIG. 30 illustrates, in Step S18, the image correction coefficients (kpix(h,v)) at a coordinate (h) in the X-direction corresponding to the light source 51 at (x3). The graph of the image correction coefficients (kpix(h,v)) illustrates an example in which the target pixels are set in the display segment regions PA at (y2) and (y4), and the correction values for increasing the gradation values are calculated. More specifically, in FIG. 30, assuming that, among the pixels 48 included in the display segment regions PA at (y2), a pixel 48 located in a position closest to the boundary between the display segment regions PA at (y1) and the display segment regions PA at (y2) serves as one end, the pixels 48 located within the area containing the predetermined number of pixels (x_pix) extending from the one end side toward the other end side are selected as the target pixels. In addition, assuming that, among the pixels 48 included in the display segment regions PA at (y2), a pixel 48 located in a position closest to the boundary between the display segment regions PA at (y2) and the display segment regions PA at (y3) serves as the other end, pixels 48 located within the area containing the predetermined number of pixels (x_pix) extending from the other end side toward the one end side are selected as the target pixels. Furthermore, assuming that, among the pixels 48 included in the display segment regions PA at (y4), a pixel 48 located in a position closest to the boundary between the display segment regions PA at (y3) and the display segment regions PA at (y4) serves as one end, the pixels 48 located within the area containing the predetermined number of pixels (x_pix) extending from the one end side toward the other end side are selected as the target pixels. Values k1 and k2 in the graph of the image correction coefficients (kpix(h,v)) are examples of specific values of ka calculated by Expression (1) above. The value k1 is a value of ka (0.24[%]) when B (P3)=120 [%], DP_con=1000, BP_con=500, BL_high=100[%], and BL_low=25[%]. The value k2 is a value of ka (0.10[%]) when B (P3)=100[%], DP_con=1000, BP_con=500, BL_high=50[%], and BL_low=25[%].

During the calculation of the output gradation values (Step S19), the image processor 107A of the modification uses the inverse luminance Egainpix(h,v), and multiplies the gradation values of the pixels 48 included in the input signals IP by the gain, and then adds the image correction coefficient (kpix(h,v)) to each of the results. Specifically, as illustrated, for example, in FIG. 28, the image processor 107A of the modification calculates the gradation value (Rout(h,v)) of the first sub-pixel 49R, the gradation value (Gout(h,v)) of the second sub-pixel 49G, and the gradation value (Bout(h,v)) of the third sub-pixel 49B that serve as the output image signals OP, as given by Expressions (2), (3), and (4) given below.

$$Rout(h,v)=Egainpix(h,v)\times Rin(h,v)+kpix(h,v) \quad (2)$$

$$Gout(h,v)=Egainpix(h,v)\times Gin(h,v)+kpix(h,v) \quad (3)$$

$$Bout(h,v)=Egainpix(h,v)\times Bin(h,v)+kpix(h,v) \quad (4)$$

As described above, according to the modification, the occurrence of the belt-like halo can be restrained in a more reliable manner even when the intermediate transmittance is included as the transmittance of the dimming areas LD.

Second Embodiment

Figure 31:
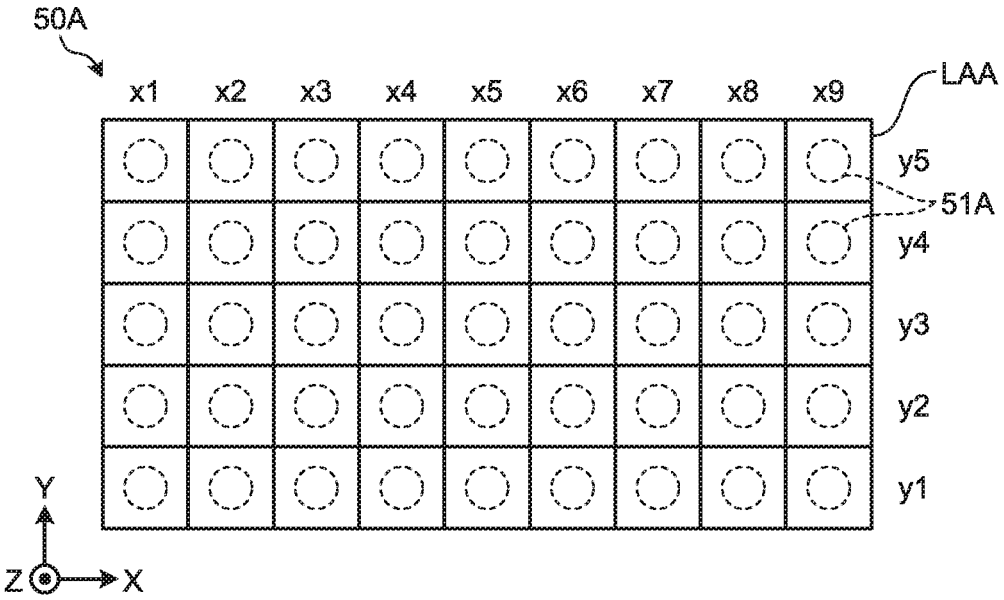
FIG. 31 is a diagram illustrating an exemplary light source device according to a second embodiment of the present invention.

FIG. 31 is a diagram illustrating an example of a light source device 50A according to a second embodiment of the present invention. The light source device 50A of the second embodiment serves as an illuminator having a plurality of light-emitting regions arranged in two intersecting directions. Specifically, as illustrated, for example, in FIG. 31, the light source device 50A of the second embodiment includes a plurality of light sources 51A arranged in the X-direction and the Y-direction.

The explanation of the second embodiment illustrates, in FIG. 31 and other figures, a case where the coordinates in the Y-direction is managed based on five coordinates of y1, y2, . . . , and y5. However, this is a mere example, and the present invention is not limited thereto. The explanation of the second embodiment also illustrates a case where the coordinate in the X-direction is managed based on the nine coordinates of x1, x2, . . . , and x9, in the same manner as the explanation of the first embodiment. However, this is a mere example, and the present invention is not limited thereto. The number of coordinates can be changed as appropriate in both the first and second embodiments.

The light source device 50A includes a light guide plate LAA that is sectioned by grooves or the like so as to guide the light of the light sources 51A provided for each of coordinate positions ((x1,y1), (x2,y1), . . . , (x8,y5), and (x9,y5)) of the display segment regions PA in the second embodiment on a coordinate position-by-coordinate position basis. This is a mere configuration example for providing the light-emitting regions arranged in the two intersecting directions. The configuration is not limited to this example. For example, light guide plates may be individually provided one for these coordinate positions each.

Figure 32:
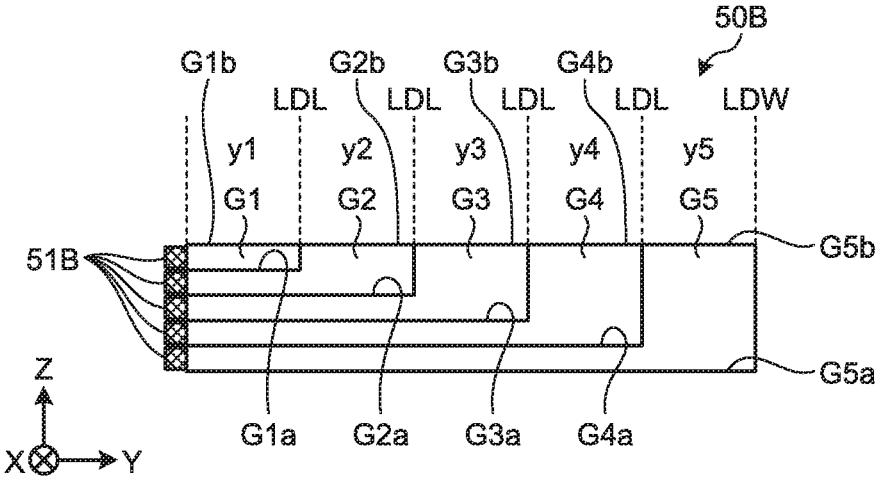
FIG. 32 is a diagram illustrating another exemplary light source device of the second embodiment.
Figure 33:
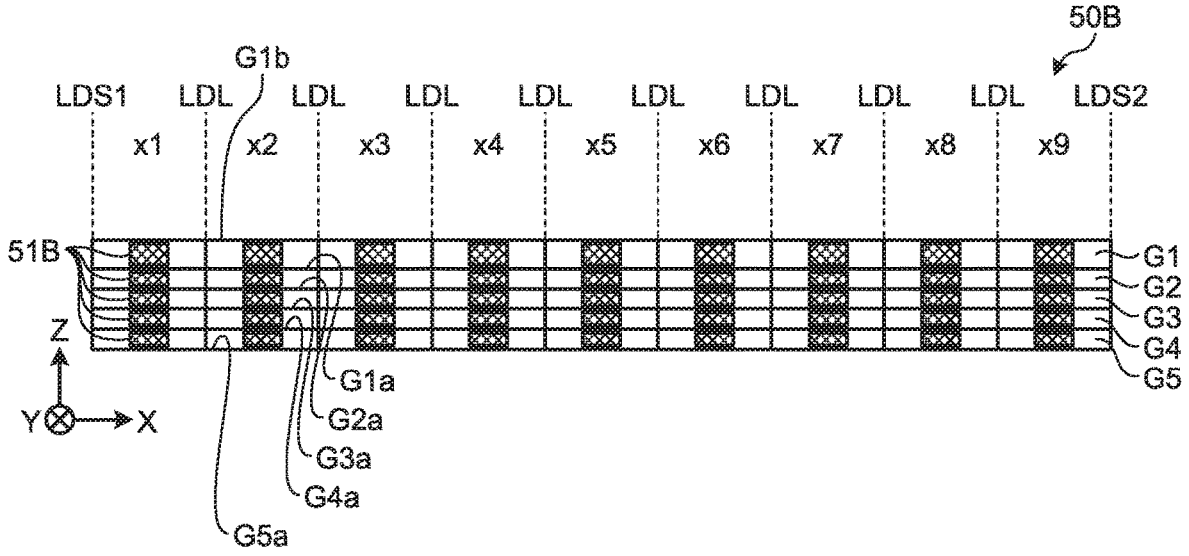
FIG. 33 is a diagram illustrating still another exemplary light source device of the second embodiment.

FIGS. 32 and 33 are diagrams illustrating another exemplary light source device of the second embodiment. As illustrated in FIGS. 32 and 33, a light source device 50B may include guide portions (such as the light guide plates G1, G2, G3, G4, and G5) and a plurality of emission portions (such as emission portions G1*b*, G2*b*, G3*b*, G4*b*, and G5*b* of the light guide plates G1, G2, G3, G4, and G5). The emission portions are arranged in the two intersecting directions, and the guide portions guide the light to the respective emission portions. The light guide plate G1 is provided with a surface on the emission portion G1*b* side of a bottom surface portion G1*a*, and a side surface portion separating the emission portions adjacent to each other at a location of the boundary LDL. The light guide plate G1 guides the light of a light source 51B provided at one end of the light guide plate G1 to (y1) by reflecting the light on the surface on the emission portion G1*b* side and on the side surface portion and by letting the light go out from the emission portion G1*b*. The light guide plate G2 is provided with a back surface of the bottom surface portion G1*a* of the light guide plate G1, a surface on the emission portion G2*b* side of a bottom surface portion G2*a*, and a side surface portion separating the emission portions adjacent to each other at the location of the boundary LDL. The light guide plate G2 guides the light of the light source 51B provided at one end of the light guide plate G2 to (y2) by reflecting the light on the back surface, on the surface on the emission portion G2*b* side, and on the side surface portion and by letting the light go out from the emission portion G2*b*. The light guide plate G3 is provided with a back surface of the bottom surface portion G2*a* of the light guide plate G2, a surface on the emission portion G3*b* side of a bottom surface portion G3*a*, and a side surface portion separating the emission portions adjacent to each other at the location of the boundary LDL. The light guide plate G3 guides the light of the light source 51B provided at one end of the light guide plate G3 to (y3) by reflecting the light on the back surface, on the surface on the emission portion G3*b* side, and on the side surface and by letting the light go out from the emission portion G3*b*. The light guide plate G4 is provided with a back surface of the bottom surface portion G3*a* of the light guide plate G3, a surface on the emission portion G4*b* side of a bottom surface portion G4*a*, and a side surface portion separating the emission portions adjacent to each other at the location of the boundary LDL. The light guide plate G4 guides the light of the light source 51B provided at one end of the light guide plate G4 to (y4) by reflecting the light on the back surface, on the surface on the emission portion G4*b* side, and on the side surface portion and by letting the light go out from the emission portion G4*b*. The light guide plate G5 is provided with a back surface of the bottom surface portion G4*a* of the light guide plate G4, a surface on the emission portion G5*b* side of a bottom surface portion G5*a*, a side surface portion separating the emission portions adjacent to each other at the location of the boundary LDL, and a side surface portion of another end LDW of the light guide plate G5. The light guide plate G5 guides the light of the light source 51B provided at one end of the light guide plate G5 to (y5) by reflecting the light on the back surface, on the surface on the emission portion G5*b* side, and on the side surface portions and by letting the light go out from the emission portion G5*b*. As described above, the light guide plates G1, G2, G3, G4, and G5 irradiate the display segment regions PA at the corresponding coordinates with light.

As illustrated in FIG. 33, the light guide plates G1, G2, G3, G4, and G5 are individually provided corresponding to y1, y2, . . . , and y5. The light source 51B is provided on one end side in the Y-direction of each of the light guide plates G1, G2, G3, G4, and G5. In other words, the light source device 50B includes the light sources 51B configured to emit light to be individually guided to (x1,y1), (x2,y1), . . . , (x8,y5), and (x9,y5). Among the light guide plates G1, G2, G3, G4, and G5, light guide plates located at both ends in the X-direction (such as at coordinates of x1 and x9) reflect light on one side surfaces LDS1 and LDS2 in the X-direction thereof.

As described above, each of the light source devices 50A and 50B of the second embodiment is provided with one or more light sources at each of a plurality of light guide regions. Specifically, either of the light sources 51A and 51B are individually provided at (x1,y1), (x2,y1), . . . , (x8,y5), and (x9,y5). In the examples described with reference to FIGS. 31, 32, and 33, each of the light guide regions corresponding to (x1,y1), (x2,y1), . . . , (x8,y5), and (x9,y5) is provided with one light source 51A or one light source 51B. However, each of the light guide regions may be provided with two or more light sources.

Figure 34:
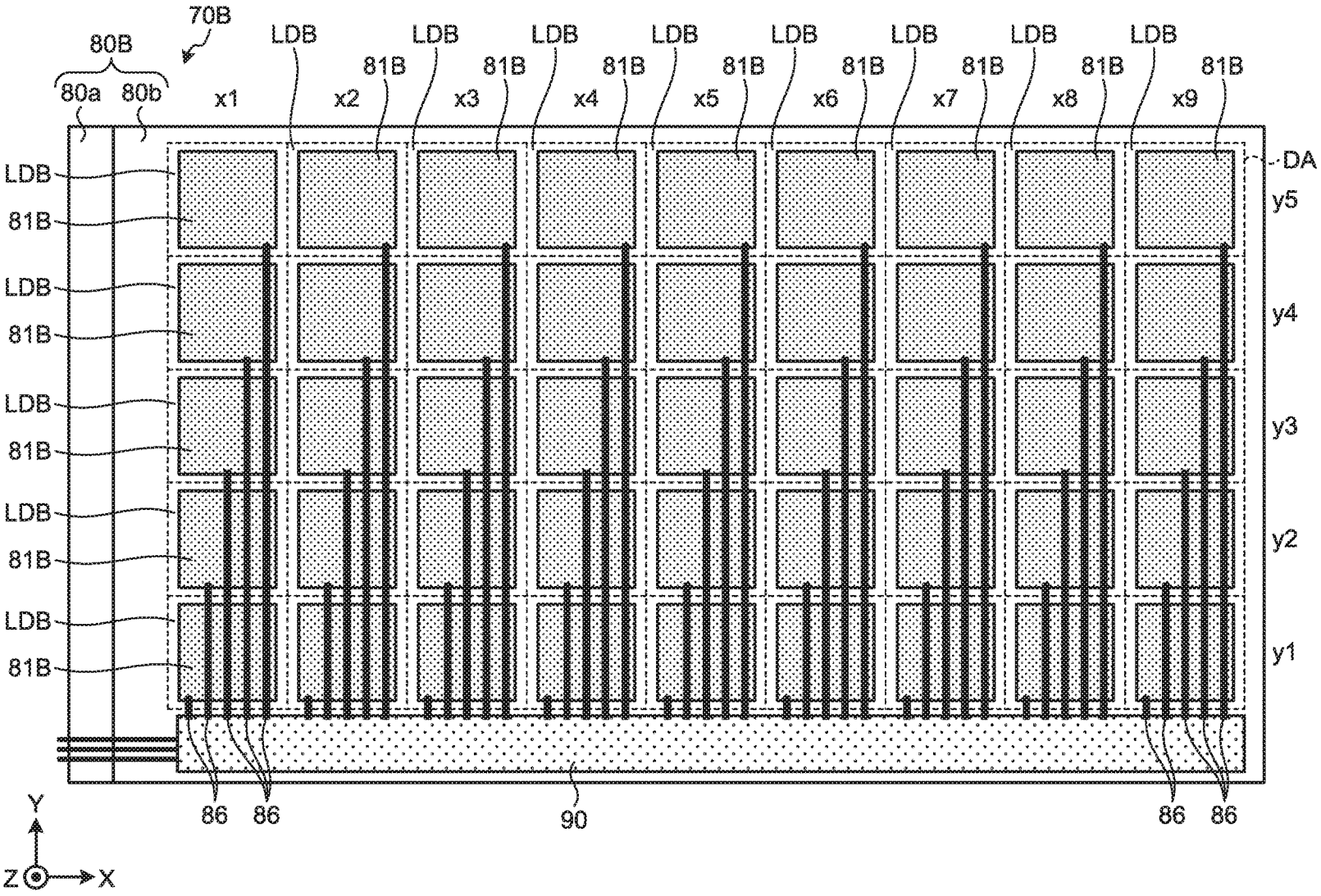
FIG. 34 is a diagram illustrating an exemplary main configuration of a dimmer according to the second embodiment.

FIG. 34 is a diagram illustrating an exemplary main configuration of a dimmer 70B according to the second embodiment. A dimming panel 80B of the second embodiment has a plurality of dimming areas LDB arranged in the two intersecting directions. Specifically, the dimming panel 80B is capable of individually adjusting the light transmittance at (x1,y1), (x2,y1), . . . , (x8,y5), and (x9,y5). As illustrated, for example, in FIG. 34, the dimming panel 80B includes first electrodes 81B individually provided at (x1, y1), (x2,y1), . . . , (x8,y5), and (x9,y5). That is, in the example illustrated in FIG. 34, the dimming areas LDB are provided with the individual first electrodes 81B.

The circuitry 90 of the second embodiment individually controls the potentials of the first electrodes 81B at different coordinate positions. The signal processor 10 of the second embodiment outputs the local dimming signals DI for individually controlling the light transmittance in the respective coordinate positions at (x1,y1), (x2,y1), . . . , (x8,y5), and (x9,y5) on a coordinate position-by-coordinate position basis.

Figure 35:
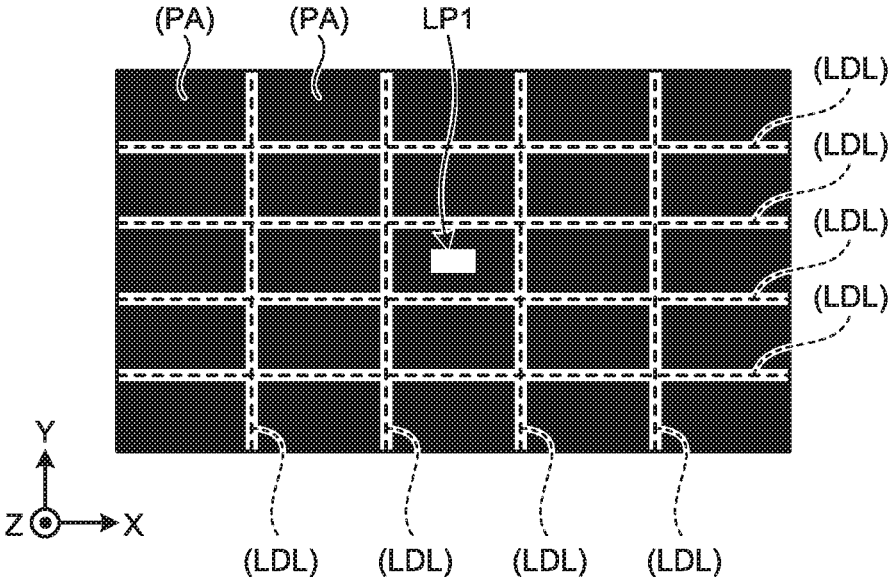
FIG. 35 is a schematic diagram illustrating an example of display output.
Figure 36:
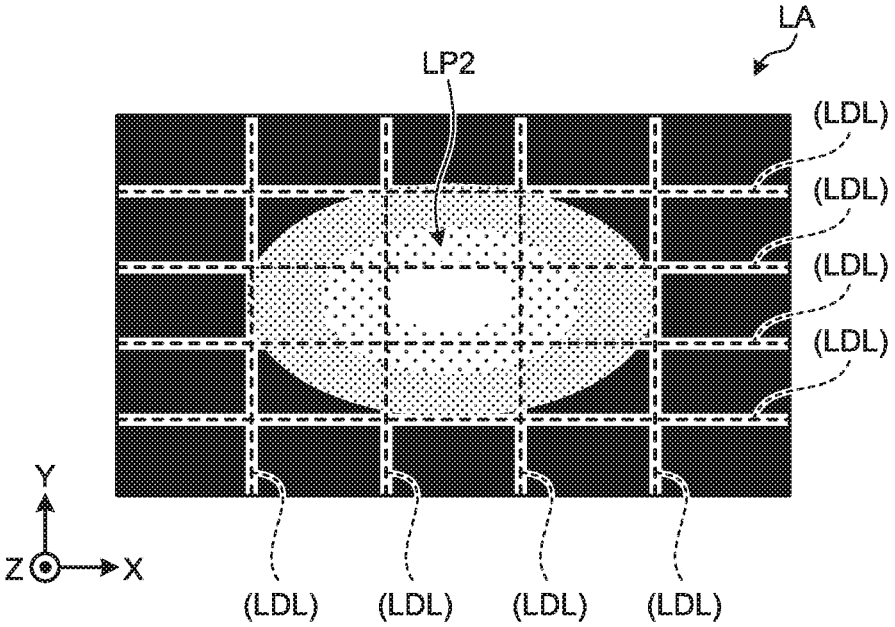
FIG. 36 is a schematic diagram illustrating an exemplary light source luminance distribution corresponding to the display output illustrated in FIG. 35.
Figure 37:
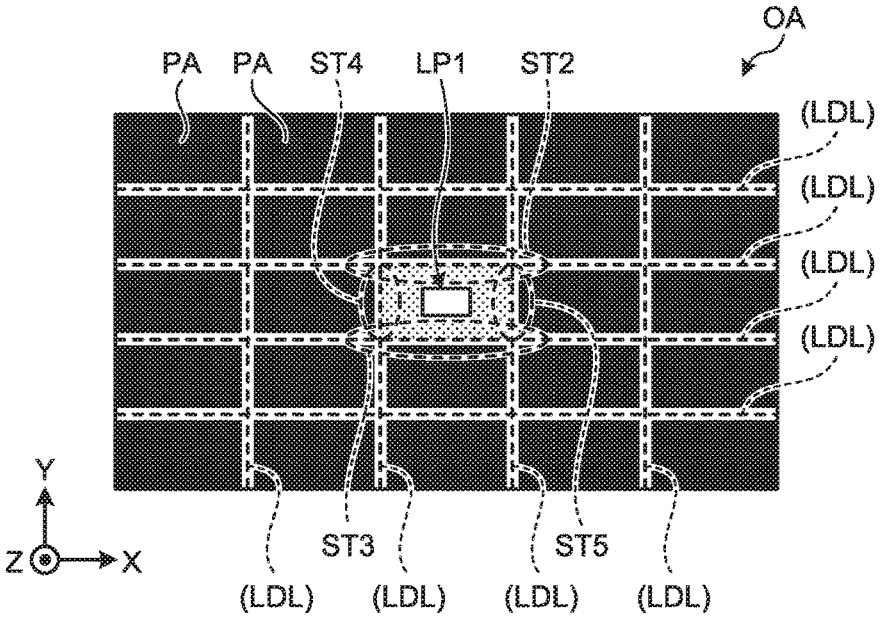
FIG. 37 is a schematic diagram illustrating a case where abrupt change lines of the output luminance are generated in the light source luminance distribution illustrated in FIG. 36.

FIG. 35 is a schematic diagram illustrating an example of display output. FIG. 35 and FIGS. 36 and 37 to be explained later illustrate the boundary lines LDL between the adjacent dimming areas LDB in order to clearly indicate the relation with the dimming areas. For example, as illustrated in FIG. 35, assume a case of requiring a display output in which one of the display segment regions PA includes a high luminance portion LP1 that requires light from the light source and the other of the display segment regions PA require the minimum luminance (black).

FIG. 36 is a schematic diagram illustrating an exemplary light source luminance distribution corresponding to the display output illustrated in FIG. 35. The light source device (such as the light source device 50A or the light source device 50B) of the second embodiment emits light from the light guide region at the same coordinates as those of the display segment region PA including the high luminance portion LP1. The light source device does not emit light from the other light guide regions. However, a part of the light from the light guide region at the same coordinates as those of the display segment region PA including the high luminance portion LP1 can reach the surrounding display segment regions PA adjacent to the display segment region PA. This phenomenon generates a light source luminance distribution LP2 centered on the display segment region PA including the high luminance portion LP1. If a display device not including the dimmer 70B is assumed, the black floating U occurs in the area of the light source luminance distribution LP2 through the same mechanism as that described with reference to FIG. 16.

FIG. 37 is a schematic diagram illustrating a case where abrupt change lines ST2, ST3, ST4, and ST5 of the output luminance are generated in the light source luminance distribution illustrated in FIG. 36. The display segment regions PA other than the display segment region PA including the high luminance portion LP1 do not need light. Accordingly, if the dimming panel 80B is operated such that the dimming areas LDB at the same coordinates as those of the display segment regions PA other than the display segment region PA including the high luminance portion LP1 have the minimum transmittance (BL_min), the output luminance in these display segment regions PA can be reduced to restrain the black floating U.

In contrast, since the display segment region PA including the high luminance portion LP1 needs light from the light source, the transmittance of a dimming area LDB at the same coordinates as those of this display segment region PA is set to transmittance (such as the maximum transmittance (BL_max)) higher than the minimum transmittance (BL_min). As a result, as illustrated in FIG. 37, the black floating U is not restrained in the display segment region PA including the high luminance portion LP1. Accordingly, the abrupt change lines ST2, ST3, ST4, and ST5 of the output luminance are generated at the boundaries between the display segment region PA including the high luminance portion LP1 and the display segment regions PA adjacent to the display segment region PA.

Accordingly, the signal processor 10 of the second embodiment serves as a controller that increases, when adjacent two of the dimming areas LDB differ in light transmittance from each other, the output gradation values of pixels located in one of the dimming areas LDB having lower light transmittance in the vicinity of the boundary (such as in an area containing the predetermined number of pixels (x_pix) extending from the boundary) between the two adjacent dimming areas LDB. This control can restrain the generation of the abrupt change lines ST2, ST3, ST4, and ST5 of the output luminance.

Figure 38:
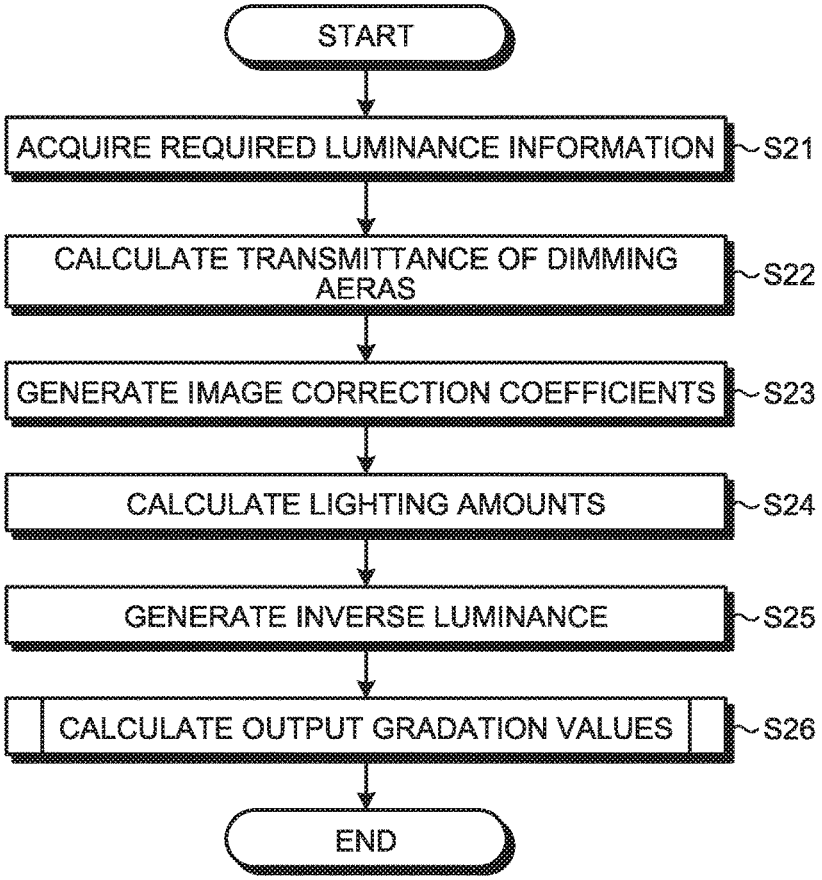
FIG. 38 is a flowchart of processing by the signal processor of the second embodiment.

FIG. 38 is a flowchart of processing by the signal processor 10 of the second embodiment. The signal processor 10 performs the acquisition of the required luminance information (Step S21), the calculation of the transmittance of the dimming areas LDB (Step S22), the generation of the image correction coefficient (Step S23), the calculation of the lighting amounts (Step S24), the generation of the inverse of the luminance (Step S25), and the calculation of the output gradation values (Step S26). Of the processes from Step S21 to Step S26, the processes from Step S22 to Step S23 and the processes from Step S24 to Step S25 may be performed in parallel after the process at Step S21. The process at Step S26 is performed after the processes at Step S23 and Step S25.

Figure 39:
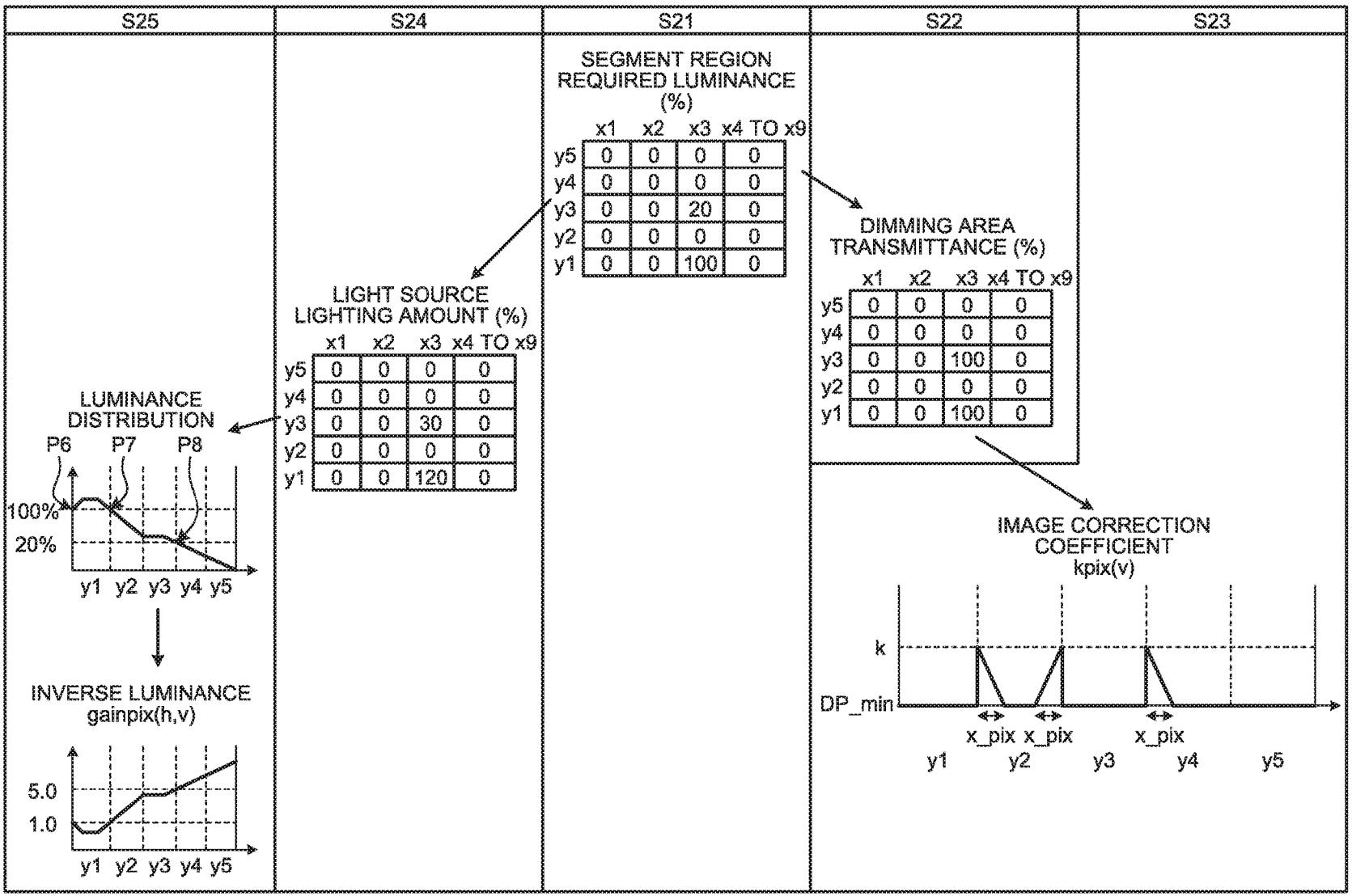
FIG. 39 is a diagram schematically illustrating an example of processing details of Step S21 to Step S25 in the flowchart illustrated in FIG. 38.

FIG. 39 is a diagram schematically illustrating an example of processing details of Step S21 to Step S25 in the flowchart illustrated in FIG. 38. The following description illustrates a case where the display device of the second embodiment includes the light source device 50B. If the display device of the second embodiment includes the light source device 50A, the following description should be read by replacing the light sources 51B with the light source 51A. During the acquisition of the required luminance information (Step S21), the required luminance information acquirer 101 acquires the luminance of the light source 51B required for each of the display segment regions PA. FIG. 39 illustrates a case where, at Step S21, the required luminance levels of the display segment regions PA at (x3,y1) and (x3,y3) are 100[%] and 20 [%], respectively, and the required luminance levels of the display segment regions PA of the other positions are 0[%].

During the calculation of the transmittance of the dimming areas (Step S22), the dimming gradation calculator 102A calculates the transmittance of the dimming areas LDB and the gradation values corresponding to the transmittance. FIG. 39 illustrates a case where, at Step S22, the transmittance levels of the dimming areas LDB at (x3,y1) and (x3,y3) are the maximum transmittance (BL_max) (expressed as 100[%] in FIG. 39), and the transmittance levels of the dimming areas LDB at the other coordinates are the minimum transmittance (BL_min) (expressed as 0[%] in FIG. 39).

During the generation of the image correction coefficient (Step S23), the image correction coefficient generator 103A calculates the image correction coefficient (kpix (v)). FIG. 39 illustrates an example in which, at Step S23, the target pixels are set in the display segment regions PA at (x3,y2) and (x3,y4), and the correction values for increasing the gradation values are calculated for the case where the gradation values of the target pixels are (R,G,B)=(0,0,0). More specifically, assuming that, among the pixels 48 included in the display segment region PA at (x3,y2), a pixel 48 located in a position closest to the boundary between the display segment region PA at (x3,y1) and the display segment region PA at (x3,y2) serves as one end, the pixels 48 located within the area containing the predetermined number of pixels (x_pix) extending from the one end side toward the other end side are selected as the target pixels. In addition, assuming that, among the pixels 48 included in the display segment region PA at (x3,y2), a pixel 48 located in a position closest to the boundary between the display segment region PA at (x3,y2) and the display segment regions PA at (x3,y3) serves as the other end, pixels 48 located within the area containing the predetermined number of pixels (x_pix) extending from the other end side toward the one end side are selected as the target pixels. In this manner, the predetermined number of pixels (x_pix) may be determined in consideration of the case where the pixels 48 located within the areas containing the predetermined number of pixels (x_pix) extending from the one end side and the other end side in one of the display segment regions PA, are selected as the target pixels. For example, the predetermined number of pixels (x_pix) may be equal to or smaller than half the number of pixels in the Y-direction included in one of the display segment regions PA. In FIG. 39, assuming that, among the pixels 48 included in the display segment regions PA at (x3,y4), a pixel 48 located in a position closest to the boundary between the display segment region PA at (x3,y3) and the display segment region PA at (x3,y4) serves as one end, the pixels 48 located within the area containing the predetermined number of pixels (x_pix) extending from the one end side toward the other end side are selected as the target pixels.

While the example illustrated in FIG. 39 illustrates the image correction coefficient (kpix (v)) in the Y-direction at (x3), the image correction coefficient generator 103A of the second embodiment also calculates the image correction coefficient (kpix (v)) in the Y-direction at coordinates other than (x3) using the same scheme. However, in the example illustrated in FIG. 39, the required luminance of the display segment regions PA is 0[%] at coordinates in the X-direction other than (x3). As a result, the correction value corresponding to the ratio (k) between the first contrast and the second contrast is not set by the image correction coefficient (kpix (v)) in the Y-direction at coordinates other than (x3).

The image correction coefficient generator 103A of the second embodiment also calculates the image correction coefficient (kpix (h)) in the X-direction using the same scheme. Specifically, to calculate the image correction coefficient (kpix (h)) at (y1), the image correction coefficient generator 103A sets the target pixels in the display segment regions PA at (x2,y1) and (x4,y1), and calculates the correction values for increasing the gradation values in the case where the gradation values of the target pixels are (R,G,B)=(0,0,0). To calculate the image correction coefficient (kpix (h)) at (y3), the image correction coefficient generator 103A sets the target pixels in the display segment regions PA at (x2,y3) and (x4,y3), and calculates the correction values for increasing the gradation values in the case where the gradation values of the target pixels are (R,G,B)=(0,0,0). The correction value corresponding to the ratio (k) between the first contrast and the second contrast is not set by the image correction coefficient (kpix (h)) in the X-direction at the other coordinates.

During the calculation of the lighting amounts (Step S24), the lighting amount calculator 104 calculates the lighting amounts of the respective light sources 51B. FIG. 39 illustrates a case where, at Step S24, the lighting amounts are calculated such that the light sources 51B at (x3,y1) and (x3,y3) are lit up at lighting amounts capable of obtaining the maximum luminance of 120 [%] and 30[%], respectively, in the display segment regions PA at (x3,y1) and (x3,y3). The lighting amount capable of obtaining the maximum luminance of 120[%] enables the display output in which luminance P6 and P7 in positions where the light from the light source 51B is weakest in the display segment region PA at (x3,y1) are caused to be luminance of 100[%]. The lighting amount capable of obtaining the maximum luminance of 30[%] enables the display output in which luminance P8 in a position where the light from the light source 51B is weakest in the display segment region PA at (x3,y3) is caused to be luminance of 20[%].

During the generation of the inverse of the luminance (Step S25), the luminance distribution generator 105 generates the information indicating the luminance distribution obtained by the lighting amounts of the light sources 51B calculated by the lighting amount calculator 104. Then, the inverse luminance generator 106 generates the inverse luminance gainpix(h,v) corresponding to the position of the pixel 48 at (h,v) based on the luminance distribution generated by the luminance distribution generator 105. FIG. 39 illustrates the luminance distribution and the inverse luminance gainpix(h,v) in the Y-direction that are generated at Step S25 corresponding to the light sources 51B at (x3).

Figure 40:
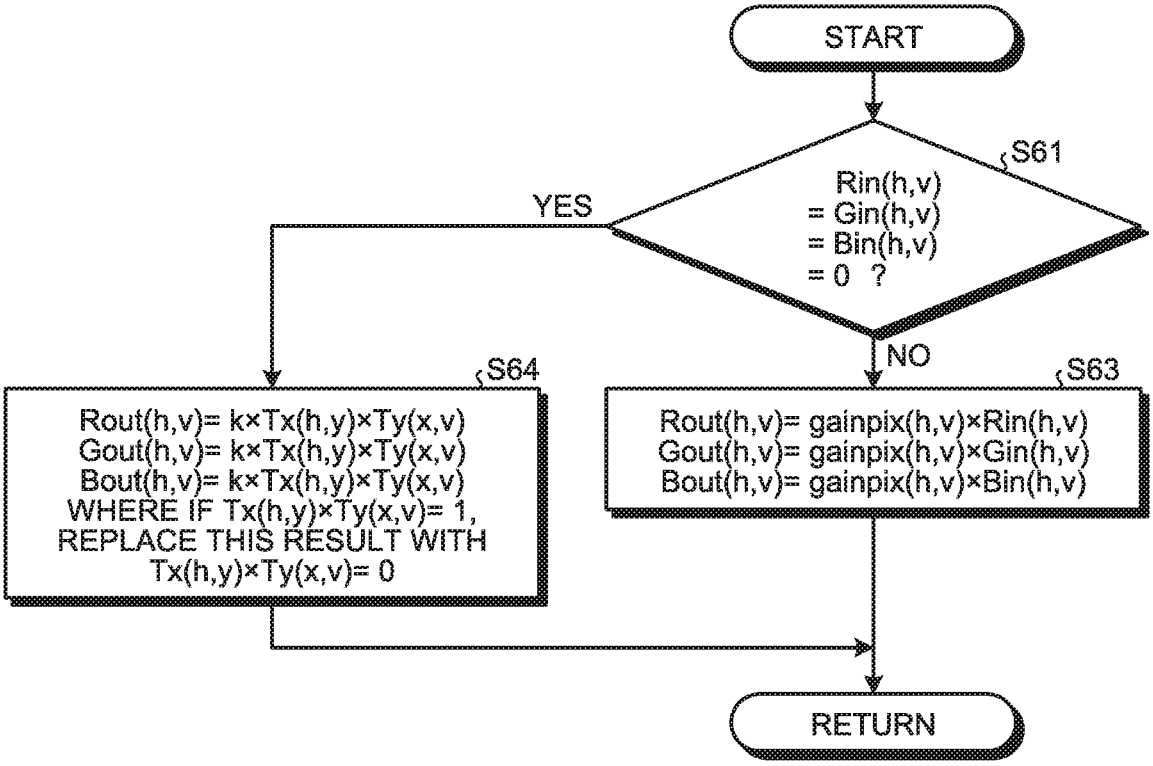
FIG. 40 is a flowchart of the calculation processing of the output gradation values in FIG. 38.

FIG. 40 is a flowchart of the calculation processing of the output gradation values in FIG. 38. During the calculation of the output gradation values (Step S26), the image processor 107A calculates the output gradation values of the pixels 48 serving as the output image signals OP. Specifically, the image processor 107A determines whether the gradation values of one of the pixels 48 included in the input signals IP are (R,G,B)=(0,0,0) (Step S61). More specifically, as illustrated, for example, in Step S61, the image processor 107A checks whether the gradation value is zero for each of the sub-pixels 49 included in the one of the pixels 48. In other words, the image processor 107A individually checks whether the gradation value (Rin(h,v)) of the first sub-pixel 49R, the gradation value (Gin(h,v)) of the second sub-pixel 49G, and the gradation value (Bin(h,v)) of the third sub-pixel 49B included in the input signals IP are zero.

If the gradation values of one of the target pixels included in the input signals IP are (R,G,B)=(0,0,0), (Yes at Steps S61), the image processor 107A calculates the gradation value of each of the sub-pixels 49 included in one of the pixels 48 determined to be the target pixels, using Expressions (5), (6), and (7) given below (Step S64). In the processing at Step S64, if Tx(h,y)×Ty(x,v)=1 (100%), this expression is replaced with Tx(h,y)×Ty(x,v)=0. In other words, if Tx(h,y)×Ty(x,v)=1 (100%), then Rout(h,v)=Gout (h,v)=Bout(h,v)=0. Tx(h,y) is a preprocessing coefficient in each position (h) of the pixels 48 arranged in the X-direction at a Y-coordinate (y). Ty(x,v) is a preprocessing coefficient in each position (v) of the pixels 48 arranged in the Y-direction at an X-coordinate (x).

$$Rout(h,v)=k\times Tx(h,y)\times Ty(x,v) \quad (5)$$

$$Gout(h,v)=k\times Tx(h,y)\times Ty(x,v) \quad (6)$$

$$Bout(h,v)=k\times Tx(h,y)\times Ty(x,v) \quad (7)$$

Figure 41:
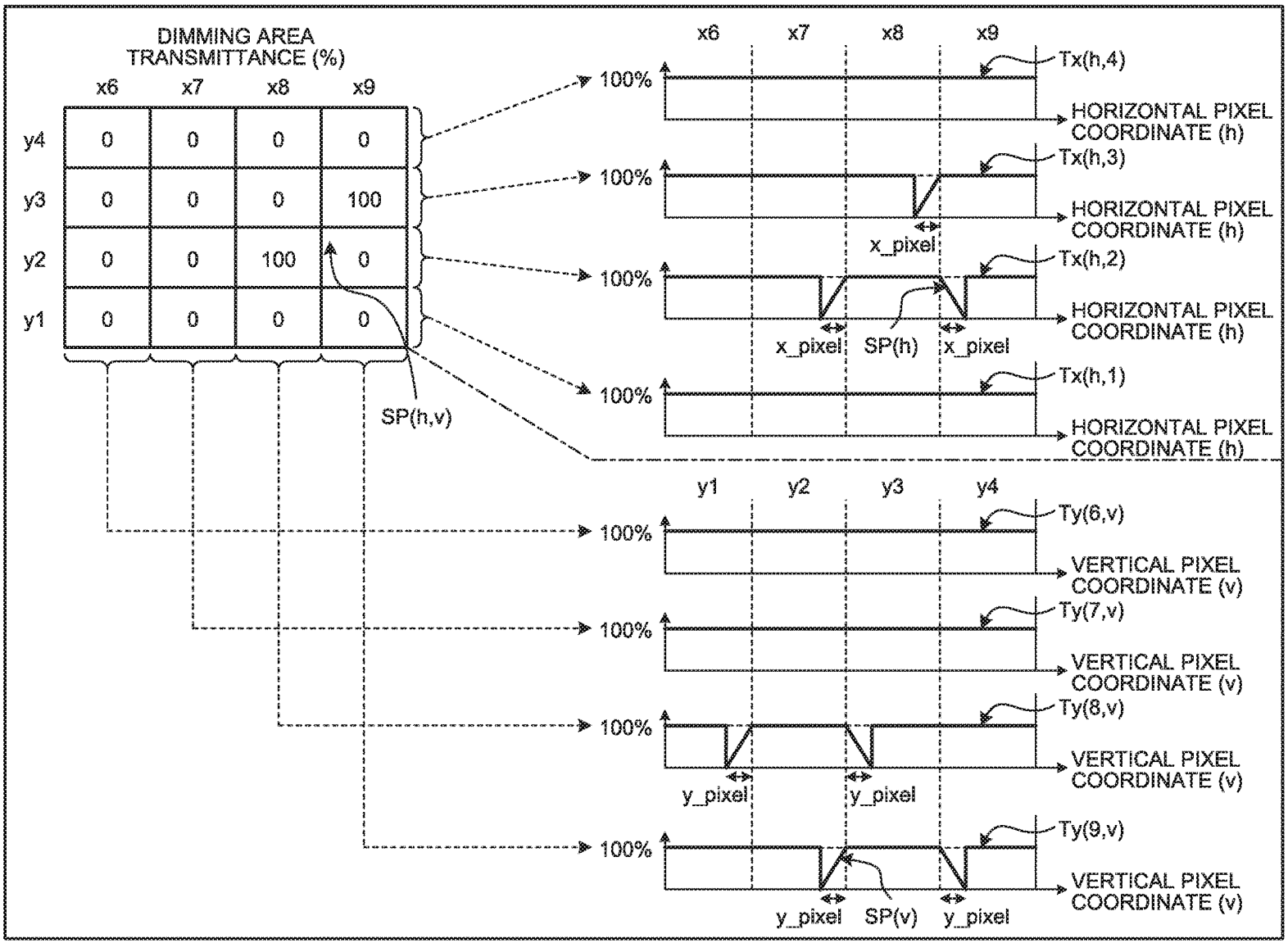
FIG. 41 is a diagram illustrating examples of preprocessing coefficients used for calculating the gradation values of target pixels in the second embodiment.

FIG. 41 is a diagram illustrating examples of the preprocessing coefficients Tx(h,y) and Ty(x,v) used for calculating the gradation values of the target pixels in the second embodiment. The image processor 107A uses the ratio (k) between the first contrast and the second contrast and the preprocessing coefficients Tx(h,y) and Ty(x,v) to calculate the gradation value of each of the sub-pixels 49 included in one of the pixels 48 determined to be the target pixels. Specifically, cases are distinguished based on whether a condition is satisfied that the light transmittance of one of the two adjacent dimming areas LDB is the maximum transmittance (BL_max) and that of the other of the two adjacent dimming areas LDB is the minimum transmittance (BL_min) at Step S22. If the condition is satisfied, the preprocessing coefficients Tx(h,y) and Ty(x,v) are set to be smaller than 1 (100%) within the area containing the predetermined number of pixels (x_pix) extending from the boundary between the two dimming areas LDB. Specifically, assuming that the dimming area LDB having the maximum transmittance (BL_max) serves as one end side and the dimming area LDB having the minimum transmittance (BL_min) serves as the other end side, the preprocessing coefficients Tx(h,y) and Ty(x,v) are set so as to gradually decrease from the one end side toward the other end side within the area containing the predetermined number of pixels (x_pix). The preprocessing coefficients Tx(h,y) and Ty(x,v) are set to 1 (100%) in the two dimming areas LDB not satisfying the condition. The above-described setting may be performed by the image processor 107A, by the image correction coefficient generator 103, or by another component included in the signal processor 10.

To simplify the explanation, FIG. 41 illustrates the preprocessing coefficients Tx(h,y) and Ty(x,v) based on an example of the transmittance values of 16 dimming areas LDB defined by a combination of coordinates x6, x7, x8, and x9 with coordinates y1, y2, y3, and y4. In FIG. 41, the dimming areas LDB at (x8,y2) and (x9,y3) have the maximum transmittance (BL_max), and the other dimming areas LDB have the minimum transmittance (BL_min). Accordingly, in FIG. 41, for example, a preprocessing coefficient Tx(h,2) at the horizontal pixel coordinate (h) at (y2) includes values smaller than 1 (100%) within the area containing the predetermined number of pixels (x_pix) on the (x8,y2) sides of (x7,y2) and (x9,y2). A preprocessing coefficient Tx(h,3) at the horizontal pixel coordinate (h) at (y3) includes values smaller than 1 (100%) within the area containing the predetermined number of pixels (x_pix) on the (x9,y3) side of (x8,y3). A preprocessing coefficient Ty(8,v) at the vertical pixel coordinate (v) at (x8) includes values smaller than 1 (100%) within the area containing a predetermined number of pixels (y_pix) on the (x8,y2) sides of (x8,y1) and (x8,y3). A preprocessing coefficient Ty(9,v) at the vertical pixel coordinate (v) at (x9) includes values smaller than 1 (100%) within the area containing the predetermined number of pixels (y_pix) on the (x9,y3) sides of (x9,y2) and (x9,y4). These preprocessing coefficients Tx(h,2), Tx(h,3), Ty(8,v), and Ty(9,v) are set to 1 (100%) except in the areas containing the predetermined number of pixels (y_pix) and areas containing the predetermined number of pixels (x_pix) specially mentioned above. Preprocessing coefficients Tx(h, 1) and Tx(h,4) at the horizontal pixel coordinate (h) at (y1) and (y4) are set to 1 (100%) regardless of the coordinate (h) in the X-direction of the pixel 48. Preprocessing coefficients Ty(6,v) and Ty(7,v) at the vertical pixel coordinate (v) at (x6) and (x7) are set to 1 (100%) regardless of the coordinate (v) in the Y-direction of the pixel 48.

As an example, if x_pix=5, that is, the area containing the predetermined number of pixels (x_pix) has a width of five pixels, the values smaller than 1 (100%) can be set as 0.99 (99%), 0.75 (75%), 0.50 (50%), 0.25 (25%), and 0.01 (1%)

from the one end side toward the other end side within the area containing the predetermined number of pixels (x_pix). These are, however, mere examples, and the values are not limited thereto. The specific value of x_pix and the specific values smaller than 1 (100%) can be changed as appropriate. The change in value from the one end side toward the other end side may be along a linear line or along a curve. The value of y_pix may be the same as or different from that of x_pix.

As described above, in the areas of the predetermined number of pixels (x_pix) and areas containing the predetermined number of pixels (y_pix) where the pixels 48 serving as the target pixels are located, at least one of the preprocessing coefficients Tx(h,y) and Ty(x,v) is set to values smaller than 1 (100%). Therefore, the image processor 107A can increase the gradation values of the target pixels by calculating the gradation values, using Expressions (5), (6), and (7) given above. Consequently, the luminance difference caused by the difference in transmittance between the two adjacent dimming areas LDB can be made less visible. Accordingly, the occurrence of the belt-like halo can be restrained, and the improvement can be made in display quality and contrast perception resulting from the restraint of the black floating U.

If any one of the display segment regions PA has the same coordinates as one of the dimming areas LDB having the minimum transmittance (BL_min) and adjacent in both the X-direction and the Y-direction to other of the dimming areas LDB having the maximum transmittance (BL_max), the one of the display segment regions PA is considered to be affected by light from both the X-direction and the Y-direction. As a result, for the target pixels under such a condition, both the preprocessing coefficient Tx(h,y) and the preprocessing coefficient Ty(x,v) are smaller than 1 (100%). For example, both the preprocessing coefficient Tx(h,y) and the preprocessing coefficient Ty(x,v) are smaller than 1 (100%) at XY-coordinates SP(h,v) represented by a combination of an X-coordinate SP (h) of one of the pixels 48 among those having the preprocessing coefficient Tx(h,2) and a Y-coordinate SP (v) of one of the pixels 48 among those having the preprocessing coefficient Ty(9,v) illustrated in FIG. 41. If the preprocessing coefficient Tx(h,y) at the X-coordinate SP (h) and the preprocessing coefficient Ty(9,v) at the Y-coordinate SP (v) are 0.8 (80%), then Tx(h,y)×Ty(x,v)=0.8×0.8=0.64. Assuming that one of two dimming areas LDB adjacent to each other in either one of the X-direction and the Y-direction has the maximum transmittance (BL_max) and the other has the minimum transmittance (BL_min), the above-given multiplication between the preprocessing coefficients Tx(h,y) and Ty(x,v) having values smaller than 1 (100%) is not applied to any one of the display segment regions PA having the same coordinates as the other dimming area LDB having the minimum transmittance (BL_min). Consequently, the preprocessing coefficient Tx(h,y) or the preprocessing coefficient Ty(x,v) of the other dimming area LDB not having the maximum transmittance (BL_max) is set to 1 (100%). Accordingly, a value smaller than 1 (100%) set as the preprocessing coefficient Tx(h,y) or the preprocessing coefficient Ty(x,v) of the one of the dimming areas LDB is reflected.

When both the preprocessing coefficients Tx(h,y) and Ty(x,v) are 1 (100%), the correction value corresponding to the ratio (k) between the first contrast and the second contrast is reflected in the pixels other than the target pixels if the gradation values are calculated without providing exceptions in Expressions (5), (6), and (7). Accordingly, if Tx(h,y)×Ty(x,v)=1 (100%), this result is replaced with Tx(h,y)×Ty(x,v)=0, whereby the pixels 48 reflecting the correction value corresponding to the ratio (k) between the first contrast and the second contrast can be limited to the target pixels.

If the gradation values of one of the pixels 48 included in the input signals IP are not (R,G,B)=(0,0,0) (No at Step S61), the image processor 107A multiplies the gradation value of each of the sub-pixels 49 included in the one of the pixels 48 by the inverse luminance gainpix(h,v) (Step S63), in the same manner as in the first embodiment. The configuration of the display device of the second embodiment is the same as that of the display device 1 of the first embodiment except in the particulars described above.

As described above, the second embodiment can restrain the occurrence of the belt-like halo with respect to both the two intersecting directions (such as the X-direction and the Y-direction).

The display device 1 and the like according to the above-described embodiments and the modification (embodiments and the like) are employed in, for example, head-up displays. This is, however, merely a specific example of the display device 1 and the like, and the present invention is not limited thereto. The display device 1 and the like can be appropriately employed to other applications, products, and the like.

The above-described embodiments and the like exemplify the case where the dimming panel (such as the dimming panel 80 or 80B) is located between the image display panel 30 and the light source device (such as the light source device 50, 50A, or 50B). This is, however, a mere example of the positional interrelation among the image display panel 30, the dimming pane, and the light source device, and the present invention is not limited thereto. For example, the dimming panel may be located on the display surface side of the image display panel 30. The dimming panel only needs to be provided on the display panel side of the light source device.

In the above-described embodiments and the like, the signal processor 10 serving as the controller determines the lighting amounts of the light sources 51, 51A, or 51B. This is, however, a mere example, and the specific details of the control are not limited thereto. The lighting amounts of the light sources 51, 51A, or 51B may be set in advance.

The concept on the correspondence relation between the transmittance and the correction values for the target pixels, such as the expressions given in the description of the one-dimensional dimming areas illustrated in the first embodiment, can be applied to the case where the transmittance of the dimming areas arranged in the one-dimensional direction (such as the X-direction) is uniform in the second embodiment. This is because, in the second embodiment, the state that the transmittance of the dimming areas arranged in the one-dimensional direction (such as the X-direction) is uniform indicates that the dimming areas are in a one-dimensionally adjusted state.

Other operational effects accruing from the aspects described in the embodiments and the like that are obvious from the description herein, or that are appropriately conceivable by those skilled in the art will naturally be understood as accruing from the present invention.

What is claimed is:

1. A display device comprising:

a display panel comprising a plurality of pixels;

a light guide plate provided on a back surface side of the display panel;

a light source configured to emit light from a lateral side of the light guide plate;

a dimming panel provided on a display panel side of the light guide plate; and a controller configured to control operations of at least the display panel and the dimming panel, wherein the dimming panel comprises a plurality of dimming areas arranged in an emission direction of the light from the light source, wherein the dimming areas are capable of individually changing transmittance of the light according to intensities of light required to display an image using the display panel, wherein, when adjacent two of the dimming areas differ in light transmittance from each other, the controller increases output gradation values of target pixels, the target pixels being located in a predetermined area extending from a boundary between the two dimming areas in one of the two dimming areas that has lower light transmittance, wherein the dimming areas are capable of changing the light transmittance to minimum transmittance, to maximum transmittance, or to any of one or more degrees of intermediate transmittance, the intermediate transmittance being transmittance between the minimum transmittance and the maximum transmittance, and wherein, when the light transmittance in one of the two adjacent dimming areas having lower light transmittance is the minimum transmittance, the controller causes the output gradation values of the target pixels to be higher than those in a case where the lower light transmittance is not the minimum transmittance.

2. The display device according to claim 1, wherein the controller is configured to set the output gradation values of the target pixels closer to the boundary between the two dimming areas to higher values.

3. The display device according to claim 1, wherein the light source emits the light from one end side of the light guide plate.

4. The display device according to claim 1, comprising a plurality of the light sources provided in positions opposed to one another with the light guide plate in between.

5. The display device according to claim 1, wherein the dimming areas extend in a direction intersecting the emission direction of the light from the light source to the light guide plate.

6. The display device according to claim 1, wherein the light guide plate comprises:

a plurality of emission portions arranged in the emission direction of the light from the light source and in a direction intersecting the emission direction; and a plurality of guide portions configured to guide the light to the respective emission portions, wherein each of the guide portions is provided with one or more of the light sources, and wherein the dimming panel comprises the dimming areas arranged in the emission direction of the light from the light source and in the direction intersecting the emission direction.

7. The display device according to claim 1, wherein the gradation values of the respective target pixels continuously decrease as a distance between the boundary and the respective target pixels increases.

8. A display device comprising: a display panel comprising a plurality of pixels;

an illuminator comprising a plurality of light-emitting regions arranged in two intersecting directions;

a dimming panel provided on a display panel side of the illuminator; and a controller configured to control operations of at least the display panel and the dimming panel, wherein the dimming panel comprises a plurality of dimming areas arranged in the two directions, wherein the dimming areas are capable of individually changing transmittance of light according to intensities of light required to display an image using the display panel, wherein, when adjacent two of the dimming areas differ in light transmittance from each other, the controller increases output gradation values of the target pixels, the target pixels being located in a predetermined area extending from a boundary between the two dimming areas in one of the two dimming areas that has lower light transmittance, such that the gradation values of the respective target pixels continuously decrease as a distance between the boundary and the respective target pixels increases, wherein the dimming areas are capable of changing the light transmittance to minimum transmittance, to maximum transmittance, or to any of one or more degrees of intermediate transmittance, the intermediate transmittance being transmittance between the minimum transmittance and the maximum transmittance, and wherein, when the light transmittance in one of the two adjacent dimming areas having lower light transmittance is the minimum transmittance, the controller causes the output gradation values of the target pixels to be higher than those in a case where the lower light transmittance is not the minimum transmittance.

* * * * *